US010297909B2

(12) United States Patent
Kim et al.

(10) Patent No.: US 10,297,909 B2
(45) Date of Patent: May 21, 2019

(54) ANTENNA DEVICE AND ELECTRONIC DEVICE INCLUDING SAME

(71) Applicant: Samsung Electronics Co., Ltd., Suwon-si, Gyeonggi-do (KR)

(72) Inventors: Tae-Young Kim, Suwon-si (KR); Yoon-Jae Lee, Seoul (KR); In-Young Lee, Hwaseong-si (KR); Won-Seok Jeong, Suwon-si (KR); Sang-Hoon Choi, Suwon-si (KR); Brian Cheon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 246 days.

(21) Appl. No.: 14/840,583

(22) Filed: Aug. 31, 2015

(65) Prior Publication Data

US 2016/0064804 A1 Mar. 3, 2016

(30) Foreign Application Priority Data

Sep. 1, 2014 (KR) ..... 10-2014-0115713

(51) Int. Cl.

| | |
|---|---|
| ***H01Q 1/24*** | (2006.01) |
| ***H01Q 1/27*** | (2006.01) |
| ***G04G 21/04*** | (2013.01) |
| ***G04R 60/06*** | (2013.01) |
| ***H01Q 7/00*** | (2006.01) |

(Continued)

(52) U.S. Cl.

CPC ..... *H01Q 1/273* (2013.01); *G04G 21/04* (2013.01); *G04R 60/06* (2013.01); *H01Q 1/243* (2013.01); *H01Q 5/371* (2015.01); *H01Q 7/00* (2013.01); *H01Q 15/008* (2013.01)

(58) Field of Classification Search

None

See application file for complete search history.

(56) References Cited

U.S. PATENT DOCUMENTS 5,982,103 A * 11/1999 Mosebrook ..... H01Q 1/007 315/149
6,373,439 B1 4/2002 Zurcher et al.
6,577,280 B2 6/2003 Kim (Continued)

FOREIGN PATENT DOCUMENTS

CN 101441727 A 5/2009
CN 102760940 A 10/2012

(Continued)

OTHER PUBLICATIONS

Chinese Office Action with English translation dated Sep. 5, 2018; Chinese Appln. No. 201580044555.9.

*Primary Examiner* — Trinh V Dinh

(74) *Attorney, Agent, or Firm* — Jefferson IP Law, LLP

(57) ABSTRACT

An antenna device implemented to prevent the deterioration in radiation performance due to a metal mechanical part and an electronic device including the same is provided. The electronic device includes a metal member in a shape of a loop that is disposed in at least one area of the electronic device and a substrate (printed circuit board (PCB)) for supplying power to a preset location of the metal member in order to use the metal member as an antenna radiator, wherein at least one location of the metal member that differs from the power-supplied location is grounded through the substrate.

15 Claims, 21 Drawing Sheets

(51) Int. Cl.
*H01Q 15/00* (2006.01)
*H01Q 5/371* (2015.01)

(56) References Cited

U.S. PATENT DOCUMENTS

| | | | |
|---|---|---|---|
| 7,196,672 | B2 | 3/2007 | Iwai et al. |
| 7,609,590 | B2 | 10/2009 | Irie |
| 7,612,725 | B2 | 11/2009 | Hill et al. |
| 8,698,680 | B2 | 4/2014 | Gutschenritter et al. |
| 8,982,000 | B2 | 3/2015 | Kim et al. |
| 9,172,148 | B2 | 10/2015 | Lyons et al. |
| 2002/0163472 | A1 | 11/2002 | Kasuya et al. |
| 2002/0163473 | A1 | 11/2002 | Koyama et al. |
| 2005/0219955 | A1 | 10/2005 | Xu et al. |
| 2009/0040876 | A1 | 2/2009 | Irie |
| 2009/0130393 | A1 | 5/2009 | Kobayashi et al. |
| 2010/0112964 | A1 | 5/2010 | Yi et al. |
| 2011/0012796 | A1 | 1/2011 | Kim et al. |
| 2013/0016016 | A1 | 1/2013 | Lin et al. |
| 2013/0181873 | A1 | 7/2013 | Gutschenritter et al. |
| 2014/0225786 | A1 | 8/2014 | Lyons et al. |
| 2014/0266920 | A1* | 9/2014 | Tran ..... H01Q 1/243 343/702 |
| 2015/0048979 | A1* | 2/2015 | Asrani ..... H01Q 1/243 343/702 |
| 2016/0056533 | A1* | 2/2016 | Nissinen ..... H01Q 9/0421 343/702 |
| 2016/0124396 | A1* | 5/2016 | Choi ..... G04R 60/10 368/281 |
| 2016/0255733 | A1* | 9/2016 | Jung ..... G06F 1/1633 361/759 |
| 2017/0062912 | A1* | 3/2017 | Shewan ..... H01Q 1/273 |

FOREIGN PATENT DOCUMENTS

| | | | |
|---|---|---|---|
| CN | 203481374 | U | 3/2014 |
| CN | 203747019 | U | 7/2014 |
| EP | 0 741 434 | A1 | 11/1996 |
| EP | 1093098 | A1 | 4/2001 |
| EP | 1 378 805 | A1 | 1/2004 |
| EP | 2182642 | A2 | 5/2010 |
| KR | 100678232 | B1 | 2/2007 |
| KR | 100995473 | B1 | 11/2010 |

* cited by examiner

ANTENNA DEVICE AND ELECTRONIC DEVICE INCLUDING SAME

CROSS-REFERENCE TO RELATED APPLICATION(S)

This application claims the benefit under 35 U.S.C. § 119(a) of a Korean patent application filed on Sep. 1, 2014 in the Korean Intellectual Property Office and assigned Serial number 10-2014-0115713, the entire disclosure of which is hereby incorporated by reference.

TECHNICAL FIELD

The present disclosure relates to an electronic device and, for example, to an electronic device including an antenna device. More particularly, the present disclosure relates to an antenna device implemented to prevent the deterioration in radiation performance due to a metal mechanical part (e.g., a metal housing, a metal bezel, and the like), and an electronic device including the same.

BACKGROUND

With the development of electronic communication technologies, electronic devices having various functions have been widely used. Such electronic devices generally have a convergence function for complexly performing one or more functions.

These electronic devices, including mobile terminals called 'smart phones' and wearable electronic devices to be worn on human bodies, have been made lighter, slimmer, shorter, and smaller, and at the same time have more functions to meet consumers' purchasing needs.

Currently, as the functional gap between electronic devices has decreased, electronic device makers have made efforts to increase the strength of the electronic devices, which have been made slimmer, and to improve design in order to meet consumers' purchasing needs. Reflecting this trend, constituent elements (e.g., external appearance) of electronic devices have been made of metal in order to increase strength and to achieve high quality and appealing external appearance of the electronic devices. In addition, efforts have been made to address the issue of grounding, degradation in antenna radiation performance, deficiency in mounting space for an antenna device, and the like, which have been caused by the use of metal.

In general, antenna radiation performance may be significantly degraded if a metal case is used in a situation where the thickness of an electronic device decreases in terms of design and a mounting space for an antenna radiator is insufficient. For example, if metal components or metal inner/outer mechanical parts exist around an antenna radiator, the capability of the antenna radiator may be considerably deteriorated by several phenomena, such as a scattering effect, an electromagnetic field trapping effect, mismatch, and the like, which are caused by metal. An electronic device of the related art has a sufficient space for mounting an antenna radiator and a sufficient separation distance from metal, and a dielectric material, such as plastic, is used as an exterior material of the product, so there is no difficulty in manufacturing an antenna radiator. However, since a currently used portable electronic device is made smaller and slimmer in order to raise consumers' purchasing needs and more frequently uses metal exterior parts, the separation distances between an antenna radiator and metal components and mechanical parts gradually decrease so that it is difficult to obtain sufficient performance using an existing antenna technology.

Among technologies of the related art for addressing such issues, the first method may have a limit on design due to the separation distance between metal and an antenna radiator. The lowermost end portion of a terminal is not formed of metal, and injection molding is applied to a certain portion that is used as a radiation space of the antenna.

The second method has to tune an unspecified slot corresponding to a frequency using the wide area of an adjacent battery cover when the battery cover is formed of metal. In this method, the tuning has to be performed many times in order to guarantee performance, so there is difficulty in determining the shape of a slot of the battery cover. Although an antenna is implemented by applying a slot to the metal battery cover, it takes a lot of time to tune the slot in order to apply the slot to an actual model, and a different model from the initial design concept may be made according to the shape of the slot.

The third method may cause a cost increase due to excess deflection of a mechanical part and added material in the process of connecting metal and an antenna, and the thickness of an electronic device may be increased due to an added component.

In the fourth method, an antenna structure (PIFA) that uses the ground as a radiator has drawbacks. For example, it has been known that since the ground is used as the radiator, the antenna characteristic may be easily changed by the human body, and an antenna gain is lowered by 6 dB or more by a person's hand. The major drawback of this method is that a variation in a current flowing in the ground may change the resonant frequency and bandwidth of the antenna.

Therefore, a need exists for an antenna device implemented to prevent the deterioration in radiation performance due to a metal mechanical part (e.g., a metal housing, a metal bezel, and the like), and an electronic device including the same.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device and an electronic device including the same.

Another aspect of the present disclosure is to provide an antenna device implemented to prevent the deterioration in radiation performance due to a metal mechanical part (e.g., a metal housing, a metal bezel, and the like), and an electronic device including the same.

Another aspect of the present disclosure is to provide an antenna device that is implemented to utilize a metal mechanical part (e.g., a metal housing, a metal bezel, and the like) as an antenna radiator, and an electronic device including the same.

Another aspect of the present disclosure is to provide an antenna device that can ensure sufficient strength and can contribute to the enhancement of radiation performance, and an electronic device including the same.

Another aspect of the present disclosure is to provide an antenna device that can provide appealing external appearance and contribute to enhancement in radiation performance, and an electronic device including the same.

In accordance with an aspect of the present disclosure, an electronic device is provided. The electronic device includes a metal member in a shape of a loop that is disposed in at least one area of the electronic device and a substrate (printed circuit board (PCB)) for supplying power to a preset location of the metal member in order to use the metal member as an antenna radiator, wherein at least one location of the metal member that differs from the power-supplied location is grounded through the substrate.

In accordance with an aspect of the present disclosure, an electronic device is provided. The electronic device includes an outer housing having a component mounting space therein, a substrate that is installed in the outer housing and includes a substrate power-supply part and a pair of substrate ground parts, a metal member that is disposed above the substrate and is used as a decoration member and an antenna radiator while being exposed to the outside of the electronic device in such a manner as to surround at least part of the periphery of the electronic device, and an inner housing that is disposed between the metal member and the substrate and includes at least one conductive pattern for electrically connecting the substrate power-supply part and the pair of substrate ground parts of the substrate to the metal member, wherein at least one operating frequency band of the metal member is changed by changing the ground location of the metal member or by changing the electrical length of the conductive pattern.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
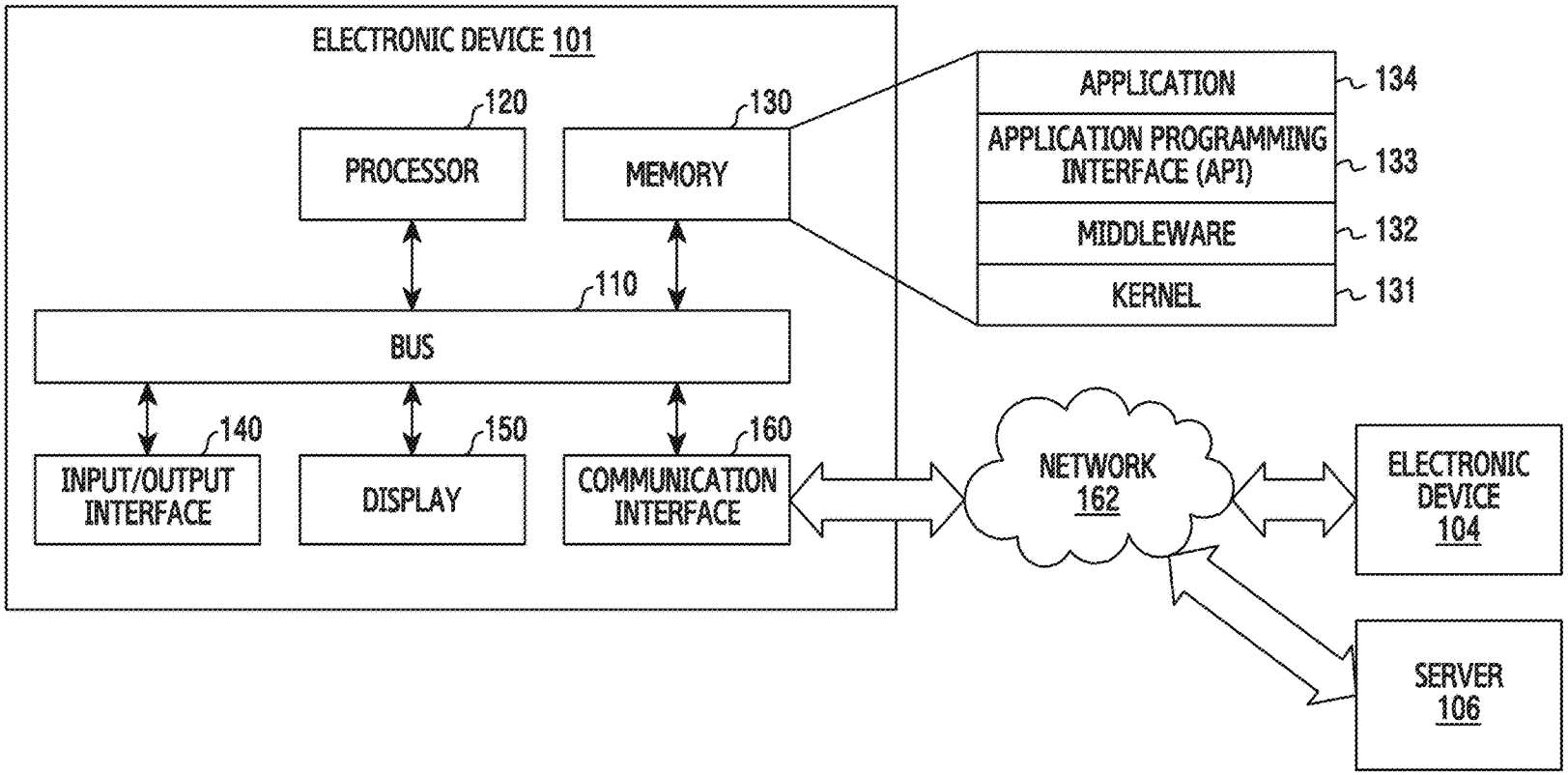
FIG. 1 illustrates a network environment including an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The terms "include" and "may include" used herein are intended to indicate the presence of a corresponding function, operation, or constitutional element disclosed herein, and are not intended to limit the presence of one or more functions, operations, or constitutional elements. In addition, the terms "include" and "have" are intended to indicate that characteristics, numbers, operations, constitutional elements, and elements disclosed in the specification or combinations thereof exist. However, additional possibilities of one or more other characteristics, numbers, operations, constitutional elements, elements or combinations thereof may exist.

As used herein, the expression "or" includes any and all combinations of words enumerated together. For example, "A or B" may include either A or B, or may include both A and B.

Although expressions used in various embodiments of the present disclosure, such as "1st", "2nd", "first", "second" may be used to express various constituent elements of the various embodiments of the present disclosure, these expressions are not intended to limit the corresponding constituent elements. For example, the above expressions are not intended to limit an order or an importance of the corresponding constituent elements. The above expressions may be used to distinguish one constituent element from another constituent element. For example, a first user device and the second user device are both user devices, and indicate different user devices. For example, a first constituent element may be referred to as a second constituent element, and similarly, the second constituent element may be referred to as the first constituent element without departing from the scope of the present disclosure.

When an element is mentioned as being "connected" to or "accessing" another element, this may mean that it is directly connected to or accessing the other element, or there may be intervening elements present between the two elements. On the other hand, when an element is mentioned as being "directly connected" to or "directly accessing" another element, it is to be understood that there are no intervening elements present.

By the term "substantially" it is meant that the recited characteristic, parameter, or value need not be achieved exactly, but that deviations or variations, including but not limited to, for example, tolerances, measurement errors, measurement accuracy limitations and other factors known to persons of ordinary skill in the art, may occur in amounts that do not preclude the effect the characteristic was intended to provide.

Unless otherwise defined, all terms, including technical and scientific terms, used herein have the same meaning as commonly understood by those of ordinary skill in the art to which various embodiments of the present disclosure belong. It will be further understood that terms, such as those defined in commonly used dictionaries, should be interpreted as having a meaning that is consistent with their meaning in the context of the relevant art and the various embodiments of the present disclosure, and should not be interpreted in an idealized or overly formal sense unless expressly so defined herein.

An electronic device according to various embodiments of the present disclosure may be a device including an antenna capable of performing a communication function in at least one frequency band. For example, the electronic device may be a smart phone, a tablet personal computer (PC), a mobile phone, a video phone, an e-book reader, a desktop PC, a laptop PC, a netbook computer, a personal digital assistant (PDA), a portable multimedia player (PMP), a moving picture experts group phase 1 or phase 2 (MPEG-1 or MPEG-2) audio layer 3 (MP3) player, a mobile medical device, a camera, and a wearable device (e.g., a head-mounted-device (HMD), such as electronic glasses, electronic clothes, an electronic bracelet, an electronic necklace, an electronic appcessory, an electronic tattoo, a smart watch, and the like).

According to certain embodiments of the present disclosure, the electronic device may be a smart home appliance having an antenna. For example, the smart home appliance may include at least one of a television (TV), a digital versatile disc (DVD) player, an audio player, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments of the present disclosure, the electronic device including the antenna may be one of various medical devices (e.g., magnetic resonance angiography (MRA), magnetic resonance imaging (MRI), computed tomography (CT), an imaging equipment, an ultrasonic instrument, and the like), a navigation device, a global positioning system (GPS) receiver, an event data recorder (EDR), a flight data recorder (FDR), a car infotainment device, electronic equipment for a ship (e.g., a vessel navigation device, a gyro compass, and the like), avionics, a security device, a car head unit, an industrial or domestic robot, an automatic teller machine (ATM), a point of sales (POS) device, and the like.

According to certain embodiments of the present disclosure, the electronic device may be part of at least one of an item of furniture or a building/structure including an antenna. The electronic device may be an electronic board, an electronic signature input device, a projector, or any of various measurement machines (e.g., water supply, electricity, gas, a propagation measurement machine, and the like).

The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments may refer to a person who uses the electronic device or a device which uses the electronic device (e.g., an artificial intelligence (AI) electronic device).

FIG. 1 illustrates a network environment including an electronic device according to an embodiment of the present disclosure.

Referring to FIG. 1, a network environment including an electronic device 101 is provided. Electronic device 101 includes a bus 110, a processor 120, a memory 130, an input/output interface 140, a display 150, and a communication interface 160.

The bus 110 is a circuit for connecting the aforementioned elements (e.g., the processor 120, the memory 130, the input/output interface 140, the display 150, and the communication interface 160) to each other and for delivering communication (e.g., a control message) between the aforementioned elements.

The processor 120 receives an instruction from the aforementioned different elements (e.g., the memory 130, the input/output interface 140, the display 150, the communication interface 160) via the bus 110, and thus may interpret the received instruction and execute arithmetic processing or data processing according to the interpreted instruction.

The memory 130 stores an instruction or data received from the processor 120 or different elements or generated by the processor 120 or the different elements. The memory 130 includes programming modules, such as a kernel 131, a middleware 132, an application programming interface (API) 133, and an application 134. Each of the aforementioned programming modules may consist of software, firmware, or hardware entities or may consist of at least two or more combinations thereof.

The kernel 131 controls or manages the system resources (e.g., the bus 110, the processor 120, the memory 130, and the like) used to execute an operation or function implemented in the middleware 132, the API 133, or the application 134. In addition, the kernel 131 provides a controllable or manageable interface by accessing individual constituent elements of the electronic device 101 in the middleware 132, the API 133, or the application 134.

The middleware 132 performs a mediation role so that the API 133 or the application 134 communicates with the kernel 131 to exchange data. In addition, regarding task requests received from the application 134, the middleware 132 performs a control (e.g., scheduling or load balancing) for the task requests by using a method of assigning a priority for using a system resource of the electronic device 101 to at least one of the application 134.

The API 133 includes at least one interface or function (e.g., an instruction) for file control, window control, video processing, character control, and the like, as an interface capable of controlling a function provided by the application 134 in the kernel 131 or the middleware 132.

The application 134 may include a short message service (SMS)/multimedia messaging service (MMS) application, an e-mail application, a calendar application, an alarm application, a health care application (e.g., an application for measuring a physical activity level, a blood sugar, and the like) or an environment information application (e.g., atmospheric pressure, humidity, or temperature information). Additionally or alternatively, the application 134 may be an application related to an information exchange between the electronic device 101 and an external electronic device 104 or a server 106. The application related to the information exchange includes a notification relay application for relaying specific information to the external electronic device 104 or a device management application for managing the external electronic device.

The notification relay application includes a function of relaying notification information generated in another application (e.g., an SMS/MMS application, an e-mail application, a health care application, an environment information application, and the like) of the electronic device 101 to the external electronic device 104 or server 106. Additionally or alternatively, the notification relay application receives notification information from the external electronic device 104, and provides the notification information to the user.

The device management application manages a function for at least one part of the external electronic device 104 which communicates with the electronic device 101. Examples of the function include turning on/turning off the external electronic device 104 itself (or some components thereof) or adjusting of a display illumination (or a resolution), and managing (e.g., installing, deleting, or updating) an application which operates in the external electronic device 104 or a service (e.g., a call service or a message service) provided by the external electronic device 104.

The application 134 includes an application specified according to attribute information (e.g., an electronic device type) of the external electronic device 104. For example, if the external electronic device 104 is an MP3 player, the application 134 may include an application related to a music play. Similarly, if the external electronic device 104 is a mobile medical device, the application 134 may include an application related to a health care. The application 134 may include at least one of a specified application in the electronic device 101 or an application received from the external electronic device 104.

The input/output interface 140 relays an instruction or data input from a user by using a sensor (e.g., an acceleration sensor, a gyro sensor, and the like) or an input device (e.g., a keyboard or a touch screen) to the processor 120, the memory 130, or the communication interface 160, for example, via the bus 110. For example, the input/output interface 140 provides data regarding a user's touch input via the touch screen to the processor 120. In addition, the input/output interface 140 outputs an instruction or data received from the processor 120, the memory 130, or the communication interface 160 to an output device (e.g., a speaker or a display), for example, via the bus 110. For example, the input/output interface 140 outputs audio data provided by using the processor 120 to the user via the speaker.

The display 150 displays a variety of information (e.g., multimedia data or text data) to the user.

The communication interface 160 connects a communication between the electronic device 101 and the external electronic device 104 or the server 106. The communication interface 160 includes an antenna 230, examples of which are described hereinafter. The communication interface 160 may communicate with the external electronic device 104 and the server 106 by being connected with a network 162 through wireless communication or wired communication.

The wireless communication includes, for example, at least one of Wi-Fi, Bluetooth (BT), near field communication (NFC), GPS, and cellular communication (e.g., long term evolution (LTE), LTE-advanced (LTE-A), code division multiple access (CDMA), wideband CDMA (WCDMA), universal mobile telecommunication system (UMTS), wireless broadband (WiBro), global system for mobile communication (GSM), and the like).

The wired communication includes, for example, at least one of universal serial bus (USB), high definition multimedia interface (HDMI), recommended standard (RS)-232, and plain old telephone service (POTS).

The network 162 may be a telecommunications network. The telecommunications network includes at least one of a computer network, an Internet, an Internet of things, and a telephone network. A protocol (e.g., a transport layer protocol, a data link layer protocol, or a physical layer protocol) for communication between the electronic device 101 and an external electronic device 104 may be supported in at least one of the application 134, the application programming interface 133, the middleware 132, the kernel 131, and the communication interface 160.

In various embodiments of the present disclosure, some mechanical parts (e.g., a metal bezel, a decoration member, and the like) constituting the external appearance of an electronic device serve as antenna radiators, but the present disclosure is not limited thereto. For example, internal mechanical parts formed of a metal material, but not the external appearance structure of an electronic device, may also serve as antenna radiators.

In various embodiments of the present disclosure, a wrist-mounted wearable electronic device is illustrated, and a metal bezel that is used as a decoration member serves as an antenna radiator, but the present disclosure is not limited thereto. It will be apparent to those skilled in the art that the present disclosure may be applied to, for example, various general electronic devices for communication, which include metal mechanical parts to be used as antenna radiators, in addition to wearable electronic devices.

Figure 2A:
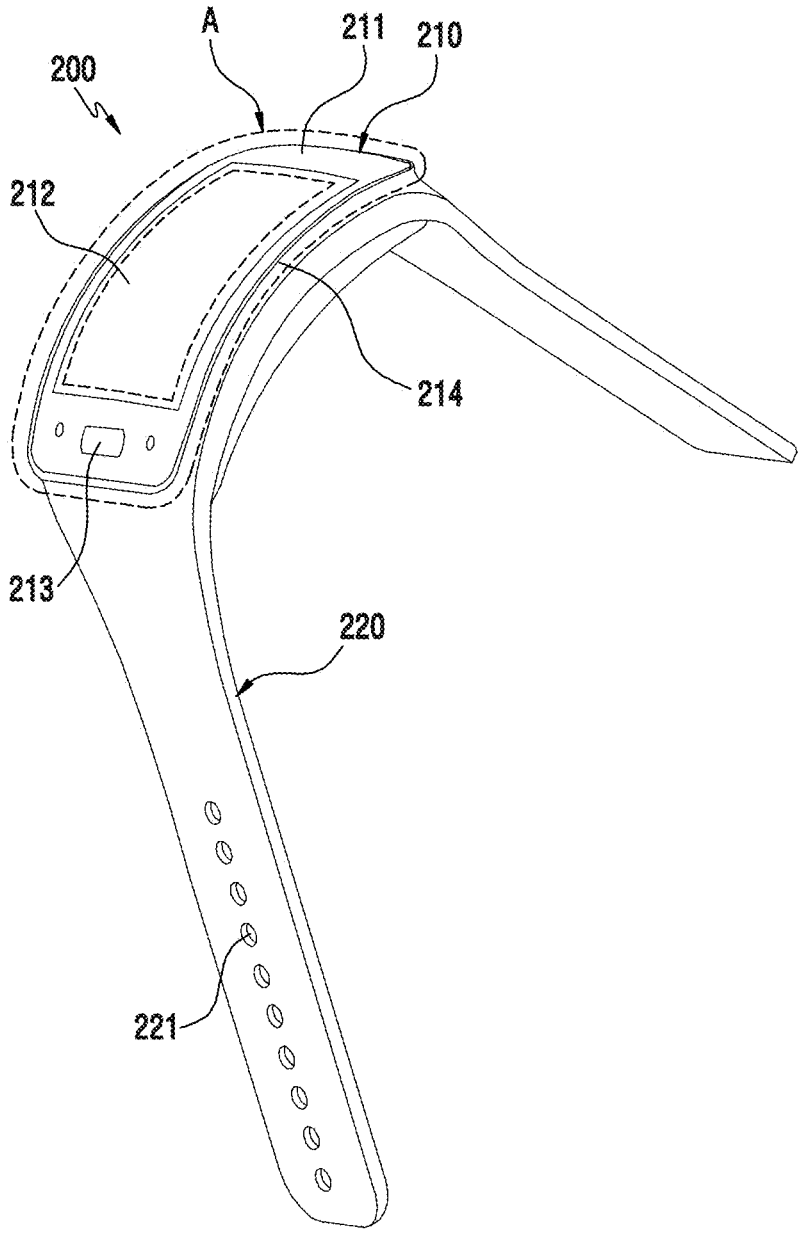
FIGS. 2A and 2B illustrate a configuration of front and rear sides of an electronic device according to various embodiments of the present disclosure.
Figure 2B:
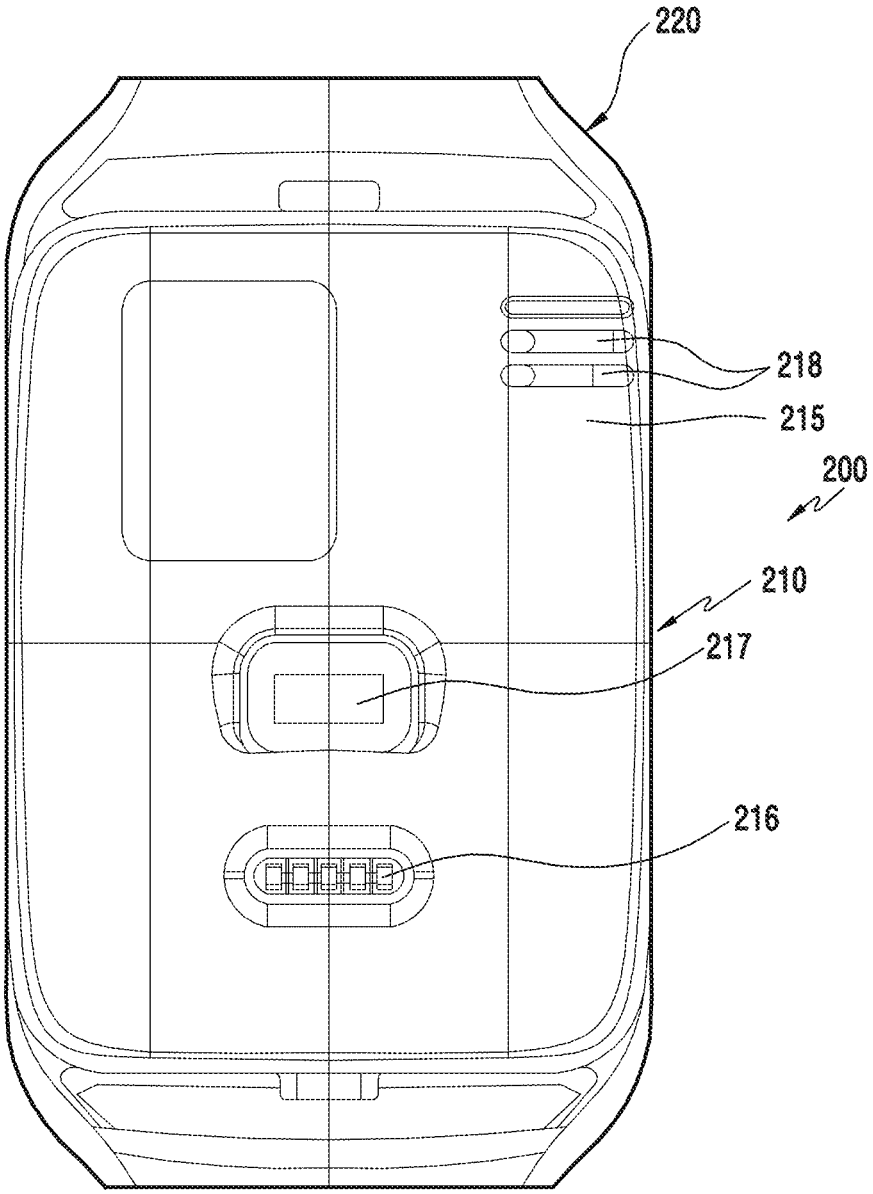

FIGS. 2A and 2B illustrate a configuration of front and rear sides of an electronic device according to various embodiments of the present disclosure.

Referring to FIGS. 2A and 2B, an electronic device 200 is a wrist-mounted wearable electronic device that can be worn on a user's wrist. According to an embodiment of the present disclosure, the electronic device 200 may include a main body 210 and a connection part 220 (e.g., a strap) on which the main body 210 is mounted. According to an embodiment of the present disclosure, the electronic device 200 may be worn by winding the connection part 220 around the user's wrist while the main body 210 is placed on the wrist, and the connection part 220 may include a plurality of openings 221 formed at a certain interval such that the wearing position of the electronic device 200 may be adjusted to be suitable for the user's wrist. According to an embodiment of the present disclosure, the connection part 220 may be formed of at least one of metal, leather, rubber, silicon, and urethane.

According to various embodiments of the present disclosure, the main body 210 may include a display 212 on a front side 211 thereof. A touch screen type of display 212 may be employed. According to an embodiment of the present disclosure, at least one key button 213 may be disposed in a proper place of the main body 210. According to an embodiment of the present disclosure, the electronic device 200 may have a battery (e.g., a rechargeable battery, and the like) therein as a power supply means, and may be selectively mounted on a portable charging cradle in order to charge the battery.

According to various embodiments of the present disclosure, the electronic device 200 may include a plurality of terminals 216 on a rear side 215 of the main body 210 thereof, which may be electrically and physically connected to connector pins of the cradle described above. According to an embodiment of the present disclosure, the terminals 216 may be exposed through the rear side 215 of the main body 210, and may be disposed to be flush with or lower than the rear side 215. According to an embodiment of the present disclosure, the electronic device 200 may also further include a sensor 217 on the rear side 215 of the main body 210 thereof, which measures the heart rate for the user's health care when the electronic device 200 is worn on the user's wrist. However, the present disclosure is not limited thereto, and various electric sensor devices may also be applied to the electronic device. According to an embodiment of the present disclosure, a speaker hole 218 for releasing a speaker sound, which is output through a speaker embedded in the electronic device, to the outside may be disposed on the rear side 215 of the main body 210. According to an embodiment of the present disclosure, although not illustrated, a microphone hole for receiving the user's voice may also be formed in a proper place of the electronic device 200 to correspond to a microphone that is disposed in the interior of the electronic device 200.

According to various embodiments of the present disclosure, the electronic device 200 may be subordinated to another electronic device, and may be used together therewith through a certain communication method. According to an embodiment of the present disclosure, the electronic device 200 may also perform wireless communication with the other electronic device using a short-range communication module, such as BT, and the like. However, the present disclosure is not limited thereto, and the electronic device 200 may also include a communication module and an antenna device so as to be independently used as an electronic device for communication.

According to various embodiments of the present disclosure, the electronic device 200 may include a metal bezel 214 that serves as the external appearance of the main body 210 and is used as decoration member. According to an embodiment of the present disclosure, the metal bezel 214 may be formed in the form of a loop that surrounds the periphery of the display 212, and may be disposed in such a manner that at least a part thereof is exposed to the outside of the main body 210. According to an embodiment of the present disclosure, the metal bezel 214 may serve as an antenna radiator of the electronic device 200. Accordingly, area A of FIG. 2A may be an area where the metal bezel 214 is disposed as an antenna radiator. According to an embodiment of the present disclosure, the metal bezel 214 may serve as a multi-band antenna radiator that operates in two or more bands.

According to various embodiments of the present disclosure, the metal bezel 214 in the form of a loop, which serves as the external appearance of the electronic device 200 and is used as a decoration member, may be used as an antenna radiator to exclude a separate antenna radiator mounting space that has to be provided in the interior of the electronic device 200, thereby contributing to the slimness of the electronic device, and the metal bezel 214 may be relatively freely designed to thereby contribute to the enhancement of a radiating performance.

Figure 3:
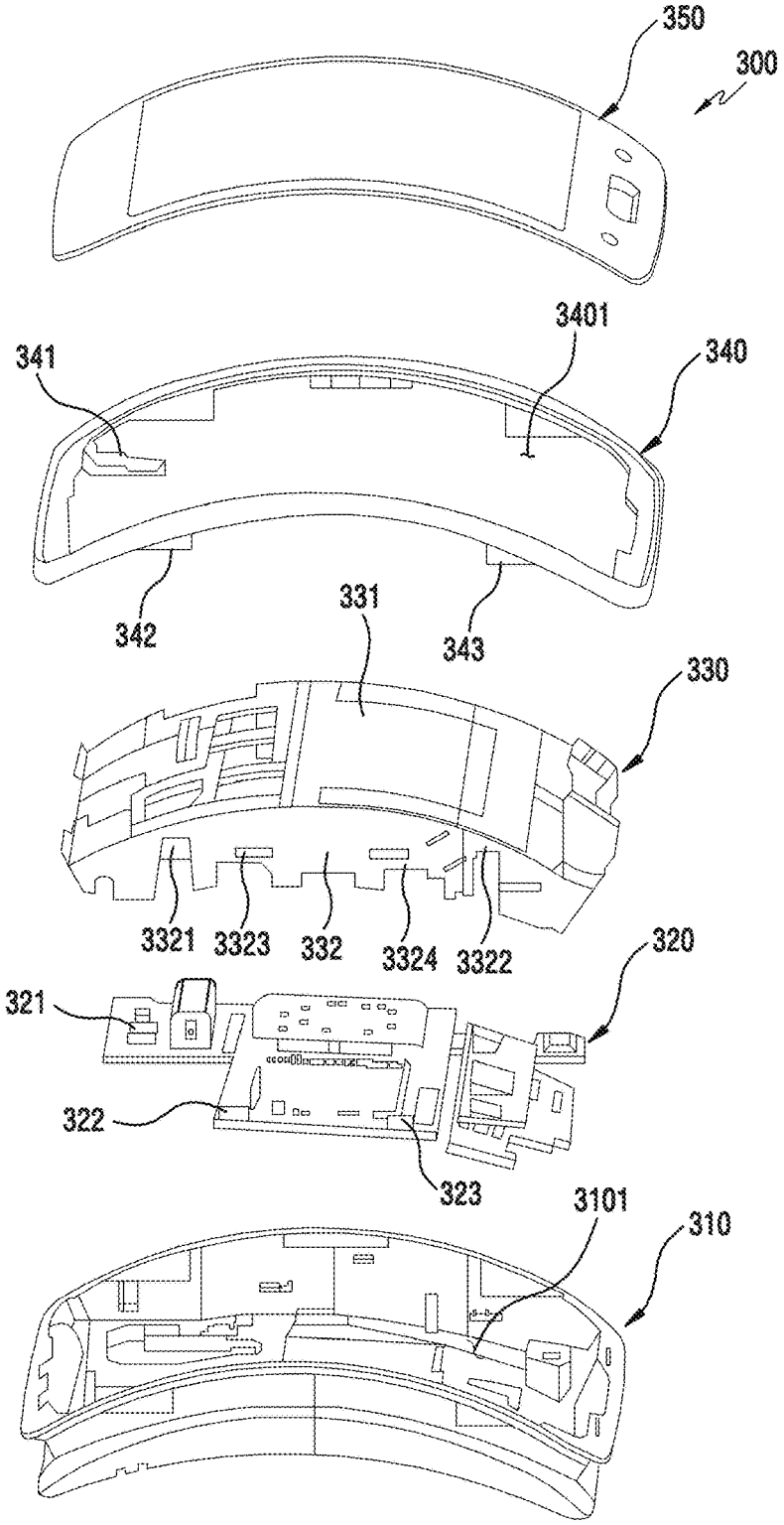
FIG. 3 is an exploded perspective view of an electronic device according to various embodiments of the present disclosure.

FIG. 3 is an exploded perspective view of an electronic device according to various embodiments of the present disclosure.

Referring to FIG. 3, according to an embodiment of the present disclosure, an electronic device 300 may be the same device as the electronic device 200 of FIGS. 2A and 2B.

Although a connection part by which the electronic device 300 may be worn on a user's wrist is omitted in FIG. 3, the electronic device 300 may include the connection part.

According to various embodiments of the present disclosure, the electronic device 300 may include an outer housing 310 that has a component mounting space 3101 therein, and a substrate 320, an inner housing 330, a metal bezel 340, and a display 350 which are sequentially mounted in the component mounting space 3101 of the outer housing 310.

According to various embodiments of the present disclosure, the metal bezel 340 may be formed in the shape of a loop that has a space 3401 in the center thereof. According to an embodiment of the present disclosure, although the metal bezel 340 is implemented in the shape of a closed loop, the metal bezel 340 may also have the shape of a partially open loop that includes a cutaway portion in at least one location. According to an embodiment of the present disclosure, the metal bezel 340 may include a power supply part 341 that may be electrically connected to a substrate power-supply part 321 of the substrate 320. According to an embodiment of the present disclosure, the metal bezel 340 may include a first ground part 342 that may be electrically connected to a first substrate ground part 322 of the substrate 320. According to an embodiment of the present disclosure, the metal bezel 340 may include a second ground part 343 that may be electrically connected to a second substrate ground part 323 of the substrate 320. According to an embodiment of the present disclosure, the first and second ground parts 342 and 343 may be disposed in the metal bezel 340 such that the distance from the power supply part 341 to the first ground part 342 differs from that from the power supply part 341 to the second ground part 343. This is for implementing an antenna radiator that can operate in different bands by making the electrical lengths from the power supply part 341 to the respective ground parts 342 and 343 different from each other.

According to various embodiments of the present disclosure, the inner housing 330 (e.g., a bracket, and the like) may be interposed between the metal bezel 340 and the substrate 320. According to an embodiment of the present disclosure, the inner housing 330 may include an upper surface 331 and side surfaces 332 that are bent along at least part of the periphery of the upper surface 331. According to an embodiment of the present disclosure, the side surfaces 332 include a plurality of conductive patterns (R1 and R2 of FIG. 6 and R3 and R4 of FIG. 7), which will be described below, and the patterns may be disposed such that the power supply part 341 and the first and second ground parts 342 and 343 of the metal bezel 340 are electrically connected to the substrate power-supply part 321 and the first and second substrate ground parts 322 and 323 of the substrate 320, respectively, by opposite ends thereof. According to an embodiment of the present disclosure, since the inner housing 330, which includes the conductive patterns, is interposed between the metal bezel 340 and the substrate 320, a change may be easily made to a desired frequency band by adjusting the electrical lengths of the conductive patterns in cases where the distance between the metal bezel 340 and the substrate 320 is relatively increased, or it is difficult to realize an operation only with the metal bezel 340 in the desired frequency band. The configuration of such conductive patterns will be described below.

According to various embodiments of the present disclosure, a first bezel connection part 3321 that is electrically connected to the first ground part 342 of the metal bezel 340 may be formed on the side surface 332 of the inner housing 330. According to an embodiment of the present disclosure, a second bezel connection part 3322 that is electrically connected to the second ground part 343 of the metal bezel 343 may be formed on the side surface 332 of the inner housing 330. According to an embodiment of the present disclosure, a first substrate connection part 3323 that is electrically connected to the first substrate ground part 322 of the substrate 320 may be formed on the side surface 332 of the inner housing 330. According to an embodiment of the present disclosure, a second substrate connection part 3324 that is electrically connected to the second substrate ground part 343 of the substrate 320 may be formed on the side surface 332 of the inner housing 330. According to an embodiment of the present disclosure, only by an operation of installing the metal bezel 340, the inner housing 330, and the substrate 320, the bezel 340 may be electrically connected to the substrate 320 through the above-described connection parts 3321, 3322, 3323, and 3324 of the inner housing 330.

According to various embodiments of the present disclosure, the power supply part 341 of the metal bezel 340 may be directly brought into physical and electrical contact with the substrate power-supply part 321 of the substrate 320. However, the present disclosure is not limited thereto, and the metal bezel 340 and the substrate 320 may also be electrically and physically connected to each other by using the conductive patterns of the inner housing 330. In addition, the first and second ground parts 342 and 343 of the metal bezel 340 may be directly physically and electrically connected to the substrate ground parts 322 and 323 of the substrate 320 without using the conductive patterns of the inner housing 330.

Figure 4:
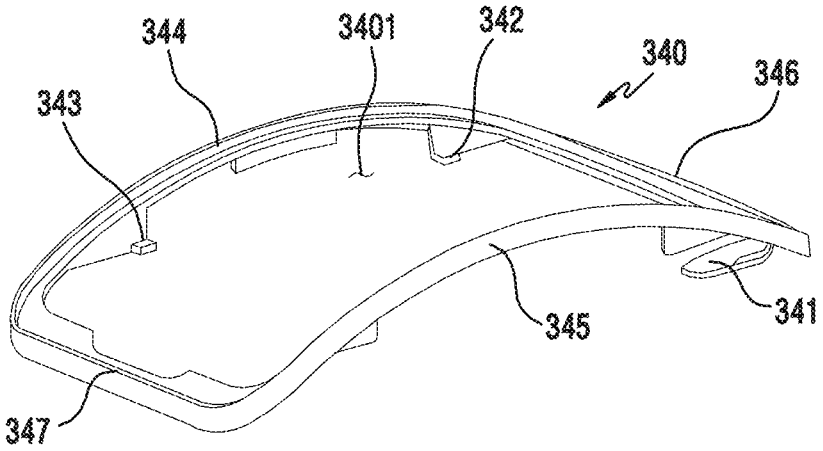
FIG. 4 is a perspective view of a metal bezel, which is utilized as an antenna radiator, according to various embodiments of the present disclosure.

FIG. 4 is a perspective view of a metal bezel, which is utilized as an antenna radiator, according to various embodiments of the present disclosure.

Referring to FIG. 4, the metal bezel 340 may be formed in the shape of a loop that has the space 3401 in the center thereof. According to an embodiment of the present disclosure, the metal bezel 340 may be applied in such a manner that the display 350 of the electronic device 300 is disposed in the central space 3401. However, the present disclosure is not limited thereto, and the metal bezel 340 may also serve as a decoration member in various areas of the electronic device 300. According to an embodiment of the present disclosure, at least part of the metal bezel 340 may also be exposed to the outside of the electronic device 300. According to an embodiment of the present disclosure, the metal bezel 340 may also be formed in the shape of a partially open loop rather than a closed loop. In this case, the metal bezel 340 may also be formed in such a manner that an opened cutaway portion is filled with a dielectric material.

According to various embodiments of the present disclosure, the metal bezel 340 may include a left bezel part 344, a right bezel part 345, an upper bezel part 346, and a lower bezel part 347. According to an embodiment of the present disclosure, the metal bezel 340 may include the power supply part 341 extending downwards from the right side of the upper bezel part 346. The power supply part 341 may have enough length to make direct physical contact with the substrate 320. According to an embodiment of the present disclosure, the first and second ground parts 342 and 343 may be sequentially formed with a certain interval therebetween on the left bezel part 344. According to an embodiment of the present disclosure, the first and second ground parts 342 and 343 may be formed to physically contact the first and second bezel connection parts 3321 and 3322 of the inner housing 330.

According to various embodiments of the present disclosure, the first and second ground parts 342 and 343 may be disposed in the metal bezel 340 such that the distance from the power supply part 341 to the first ground part 342 differs from that from the power supply part 341 to the second ground part 343. According to an embodiment of the present disclosure, the distance from the power supply part 341 to the first ground part 342 in one direction may be different from that from the power supply part 341 to the second ground part 343 in the opposite direction. For example, if the distance (electrical length) from the power supply part 341 to the first ground part 342 is shorter than that (electrical length) from the power supply part 341 to the second ground part 343, the part of the metal bezel 340 formed from the power supply part 341 to the first ground part 342 may be used as an antenna radiator that operates in a higher frequency band than the part of the metal bezel 340 formed from the power supply part 341 to the second ground part 343. According to an embodiment of the present disclosure, if there is no cutaway portion between the power supply part 341 and the first ground part 342 in one direction and between the power supply part 341 and the second ground part 343 in the opposite direction, the whole part of the metal bezel 340 may also be used as a planar inverted-f antenna (PIFA) that operates in a relatively higher frequency band.

Figure 5:
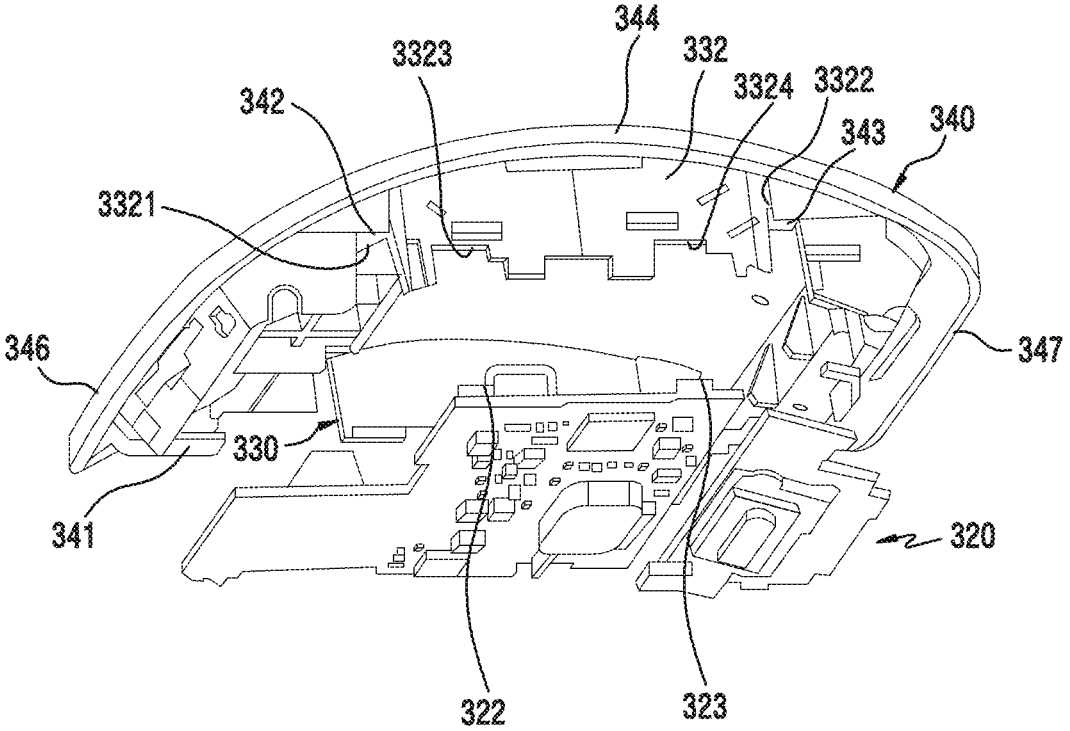
FIG. 5 illustrates a state in which an inner housing and a substrate are applied to a metal bezel according to various embodiments of the present disclosure.

FIG. 5 illustrates a state in which an inner housing and a substrate are applied to a metal bezel according to various embodiments of the present disclosure.

Referring to FIG. 5, the first ground part 342 of the metal bezel 340 may be electrically connected to the first bezel connection part 3321 formed on the side surface 332 of the inner housing 330 while the metal bezel 340 and the inner housing 330 are coupled to each other. According to an embodiment of the present disclosure, the second ground part 343 of the metal bezel 340 may be electrically connected to the second bezel connection part 3322 formed on the side surface 332 of the inner housing 330.

According to various embodiments of the present disclosure, only by an operation of assembling the inner housing 330 and the substrate 320, the first substrate ground part 322 of the substrate 320 may be electrically connected to the first substrate connection part 3323 of the inner housing 330, and the second substrate ground part 323 of the substrate 320 may be electrically connected to the second substrate connection part 3324 of the inner housing 330. According to an embodiment of the present disclosure, one or more conductive patterns (R1, R2, R3, and R4 of FIGS. 5 and 6), which have a certain length and shape, may be formed on the side surface 332 of the inner housing 330. According to an embodiment of the present disclosure, at least one pattern may electrically connect the first bezel connection part 3321 and the first substrate connection part 3323. According to an embodiment of the present disclosure, at least one pattern may electrically connect the second bezel connection part 3322 and the second substrate connection part 3324.

Figure 6:
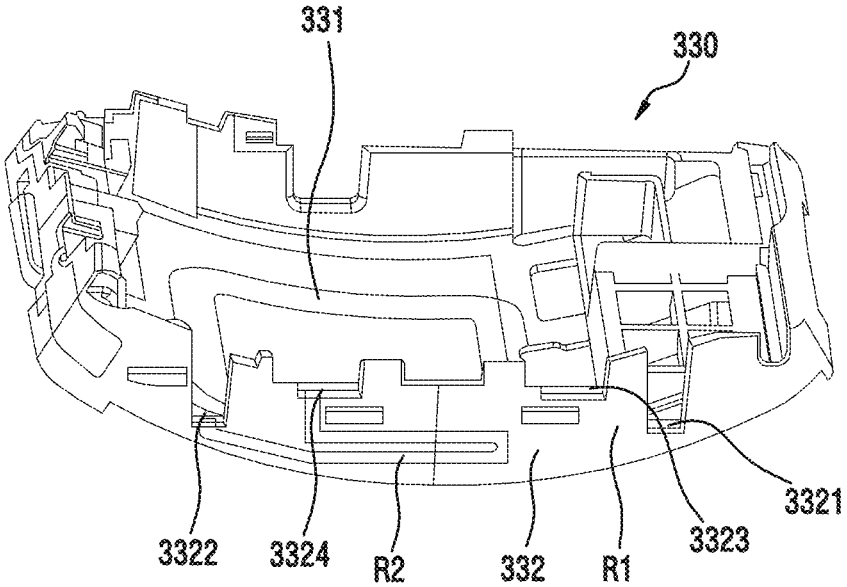
FIGS. 6 and 7 are perspective views of an inner housing according to various embodiments of the present disclosure.
Figure 7:
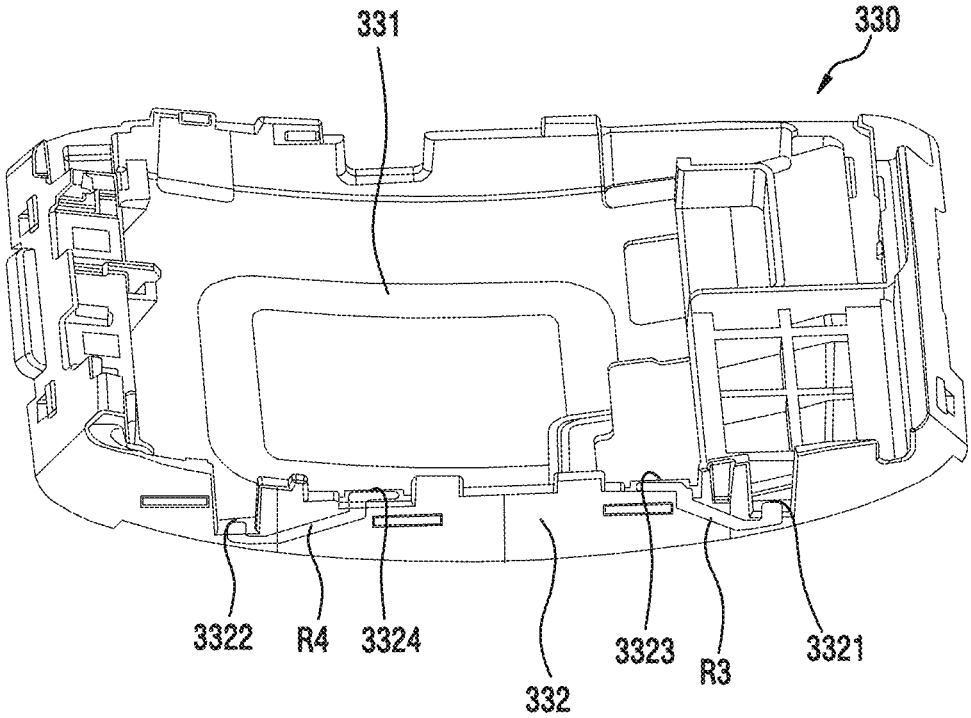

FIGS. 6 and 7 are perspective views of an inner housing according to various embodiments of the present disclosure.

Referring to FIGS. 5 and 6, the inner housing 330 may include a pair of conductive patterns R1 and R2 formed on the side surface 332 thereof. According to an embodiment of the present disclosure, the conductive pattern R1 may operate together with an antenna radiator in the shape of a loop in a relatively higher frequency band that is formed by the power supply part 341 and the first ground part 342 of the metal bezel 340, and the substrate 320. According to an embodiment of the present disclosure, the conductive pattern R2 may operate together with an antenna radiator in the shape of a loop in a relatively lower frequency band that is formed by the power supply part 341 and the second ground part 343 of the metal bezel 340, and the substrate 320.

According to various embodiments of the present disclosure, the first bezel connection part 3321 may be electrically connected to the first ground part 342 of the metal bezel 340, and the first substrate connection part 3323 may be electrically connected to the first substrate ground part 332 of the substrate 320. Accordingly, the conductive pattern R1 functions to electrically connect the first ground part 342 of the metal bezel 340 to the first substrate ground part 322 of the substrate 320.

According to various embodiments of the present disclosure, the second bezel connection part 3322 may be electrically connected to the second ground part 343 of the metal bezel 340, and the second substrate connection part 3324 may be electrically connected to the second substrate ground part 323 of the substrate 320. Accordingly, the conductive pattern R2 functions to electrically connect the second ground part 343 of the metal bezel 340 to the second substrate ground part 323 of the substrate 320.

Figure 12A:
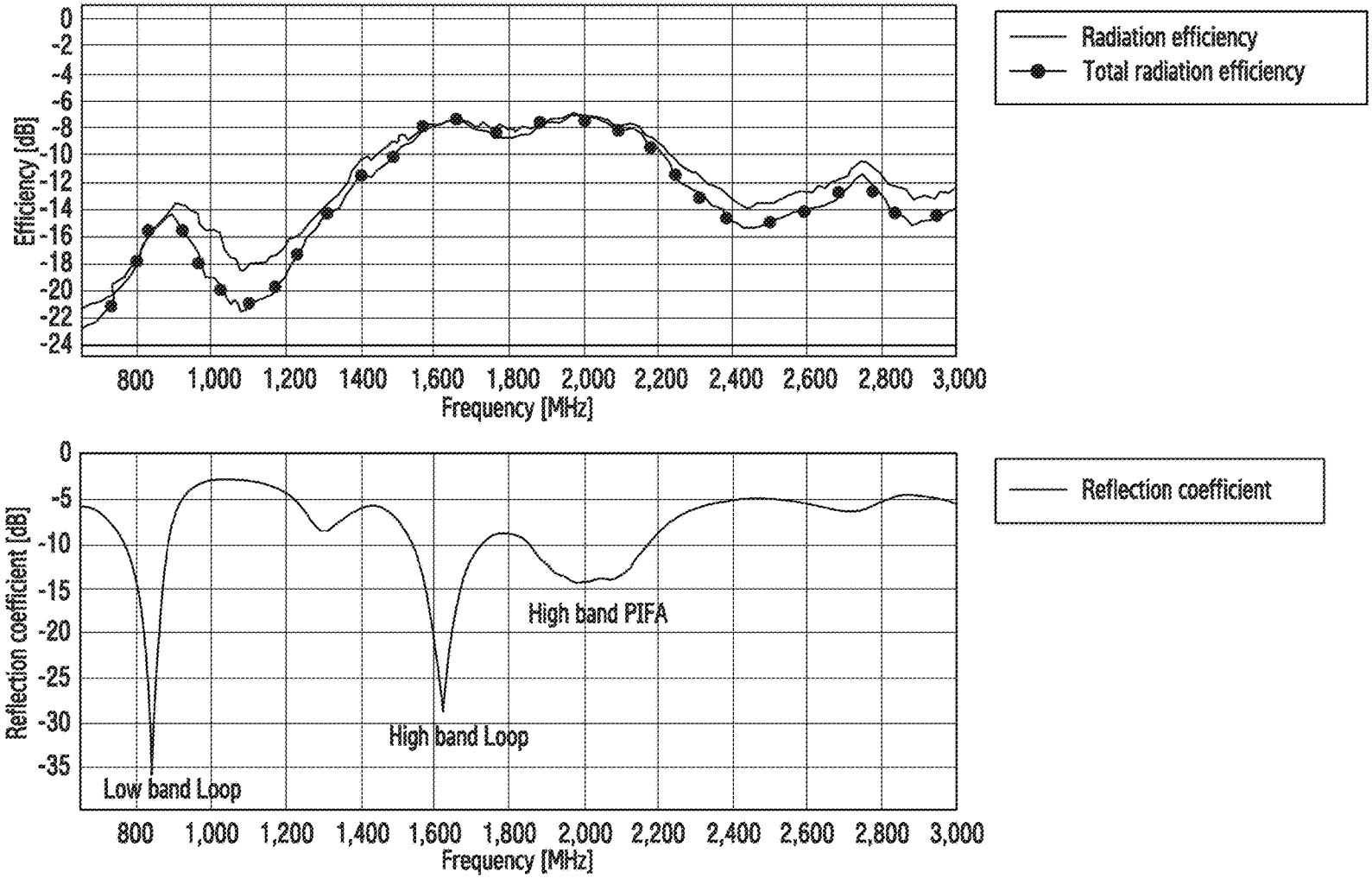
FIG. 12A is a graph depicting a characteristic of an antenna device when an inner housing is applied according to various embodiments of the present disclosure.

FIG. 12A is a graph depicting a characteristic of an antenna device when an inner housing is applied according to various embodiments of the present disclosure.

Referring to FIG. 12A, according to an embodiment of the present disclosure, a graph is illustrated depicting the radiation characteristic of the metal bezel 340, which is used as an antenna radiator, when the conductive patterns R1 and R2 of FIG. 6 are applied, and each resonance mode can be identified from the reflection coefficient characteristic.

Referring to FIG. 7, the inner housing 330 may include a pair of conductive patterns R3 and R4 formed on the side surface 332 thereof. According to an embodiment of the present disclosure, the conductive pattern R3 may operate together with an antenna radiator in the shape of a loop in a relatively higher frequency band that is formed by the power supply part 341 and the first ground part 342 of the metal bezel 340, and the substrate 320. According to an embodiment of the present disclosure, the conductive pattern R4 may operate together with an antenna radiator in the shape of a loop in a relatively lower frequency band that is formed by the power supply part 341 and the second ground part 343 of the metal bezel 340, and the substrate 320.

According to various embodiments of the present disclosure, the first bezel connection part 3321 may be electrically connected to the first ground part 342 of the metal bezel 340, and the first substrate connection part 3323 may be electrically connected to the first substrate ground part 332 of the substrate 320. Accordingly, the conductive pattern R3 functions to electrically connect the first ground part 342 of the metal bezel 340 to the first substrate ground part 322 of the substrate 320.

According to various embodiments of the present disclosure, the second bezel connection part 3322 may be electrically connected to the second ground part 343 of the metal bezel 340, and the second substrate connection part 3324 may be electrically connected to the second substrate ground part 323 of the substrate 320. Accordingly, the conductive pattern R4 functions to electrically connect the second ground part 343 of the metal bezel 340 to the second substrate ground part 323 of the substrate 320.

Figure 12B:
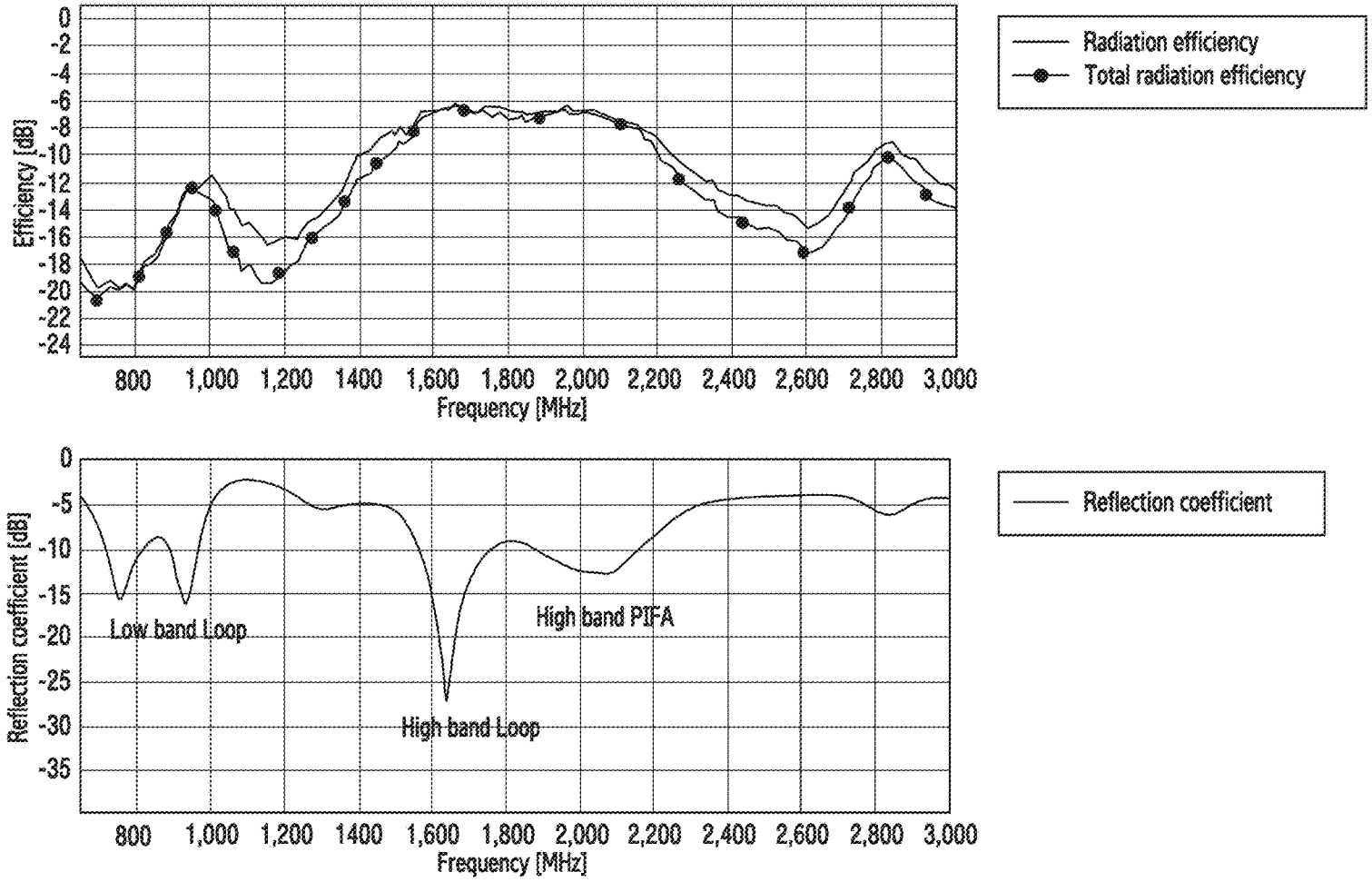
FIG. 12B is a graph depicting a characteristic of an antenna device when an inner housing is applied according to various embodiments of the present disclosure.

FIG. 12B is a graph depicting a characteristic of an antenna device when an inner housing is applied according to various embodiments of the present disclosure.

Referring to FIG. 12B, according to an embodiment of the present disclosure, a graph is illustrated depicting the radiation characteristic of the metal bezel 340, which is used as an antenna radiator, when the conductive patterns R3 and R4 of FIG. 7 are applied, and each resonance mode can be identified from the reflection coefficient characteristic.

According to various embodiments of the present disclosure, it can be seen in FIGS. 12A and 12B that the resonant frequency in the low frequency band is lowered when the electrical length of the conductive pattern R2 in the low frequency band is formed to be longer than that of the conductive pattern R4 in the metal bezel 340 which has the same shape and condition.

According to various embodiments of the present disclosure, the conductive patterns R1, R2, R3, and R4 may be formed on the inner housing 330, which is made of a synthetic resin material, through a laser direct structuring (LDS) method. However, the present disclosure is not limited thereto, and the conductive patterns may also be formed through in-mold antenna (IMA) method, or if there is space, the conductive patterns may also be formed in such a manner that at least one of a flexible printed circuit (FPC) on which a thin metal plate or pattern is formed and a metal tape is attached to the side surface of the inner housing. According to an embodiment of the present disclosure, the conductive patterns may also be formed in such a manner of applying a conductive spray to the side surface of the inner housing. According to an embodiment of the present disclosure, the conductive patterns may also be formed by insert molding or double injection molding in such a manner that the conductive patterns are or are not exposed through the inner or outer surface of the inner housing, which is made of a synthetic resin material.

According to various embodiments of the present disclosure, among the two conductive patterns R1 and R2 or R3 and R4 disposed on the side surface 332 of the inner housing 330, only one may be electrically connected to the substrate ground parts 322 and 323 of the substrate 320, and the other may not be connected thereto and may be used as a parasitic pattern, thereby ensuring a broadband antenna performance and forming different frequency performances according to length and width variations.

Figure 8:
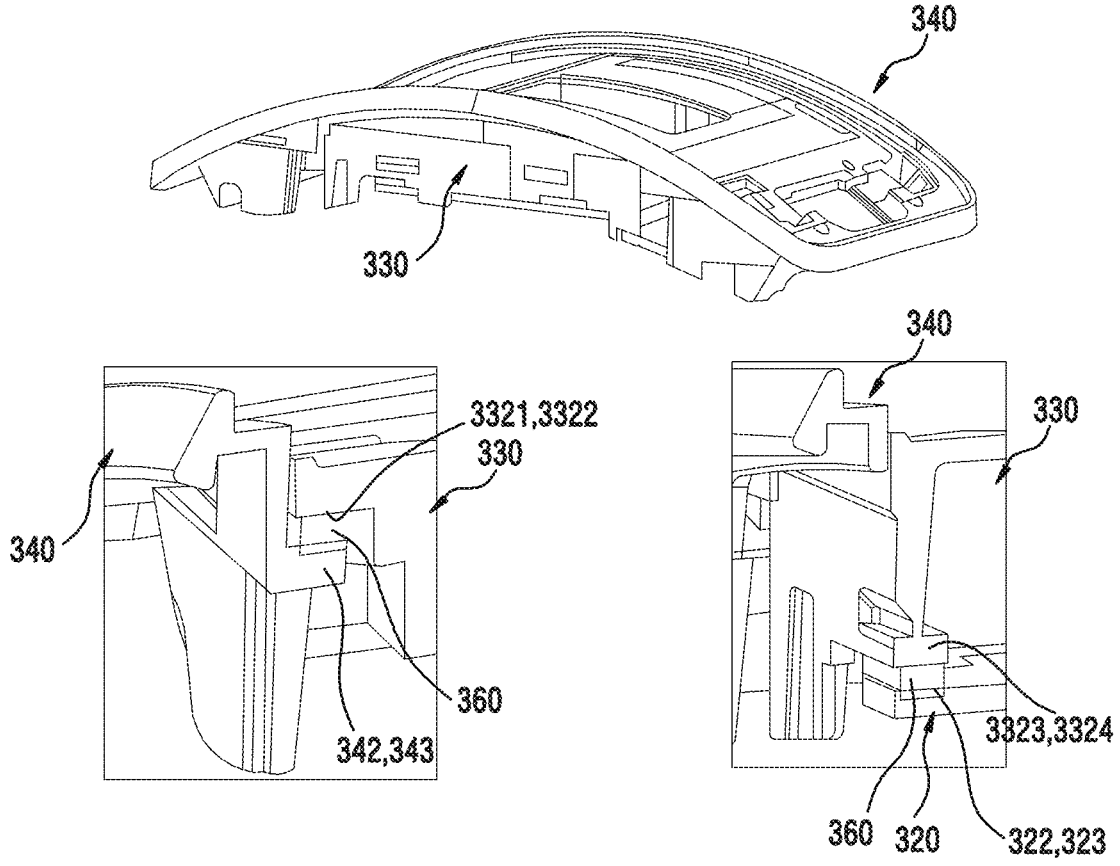
FIG. 8 illustrates a state in which a metal bezel and a substrate are electrically connected by an inner housing according to various embodiments of the present disclosure.

FIG. 8 illustrates a state in which a metal bezel and a substrate are electrically connected by an inner housing according to various embodiments of the present disclosure.

Referring to FIG. 8, when the metal bezel 340 and the inner housing 330 are coupled to each other, the first and second bezel connection parts 3321 and 3322 of the inner housing 330 may be brought into physical contact with each other by the first and second ground parts 342 and 343 of the metal bezel 340 and a conductive connection member 360. According to an embodiment of the present disclosure, the first and second substrate connections parts 3323 and 3324 of the inner housing 330 may also be brought into physical contact with each other by the first and second substrate ground parts 322 and 323 of the substrate 320 and the conductive connection member 360. According to an embodiment of the present disclosure, a conductive sponge or a conductive Poron tape may be used as the conductive connection member 360.

Although not illustrated, the power supply part of the metal bezel 340 and the substrate power-supply part of the substrate 320 may also be brought into direct contact with each other, may be electrically connected to each other using the above-described conductive connection part 360, or may be connected to each other using a connecting member, such as a C-clip, and the like.

FIGS. 9A, 9B, 9C, and 9D schematically illustrate electrical lengths in various frequency bands that are applied when a metal bezel is used as an antenna radiator according to various embodiments of the present disclosure.

Figure 9A:
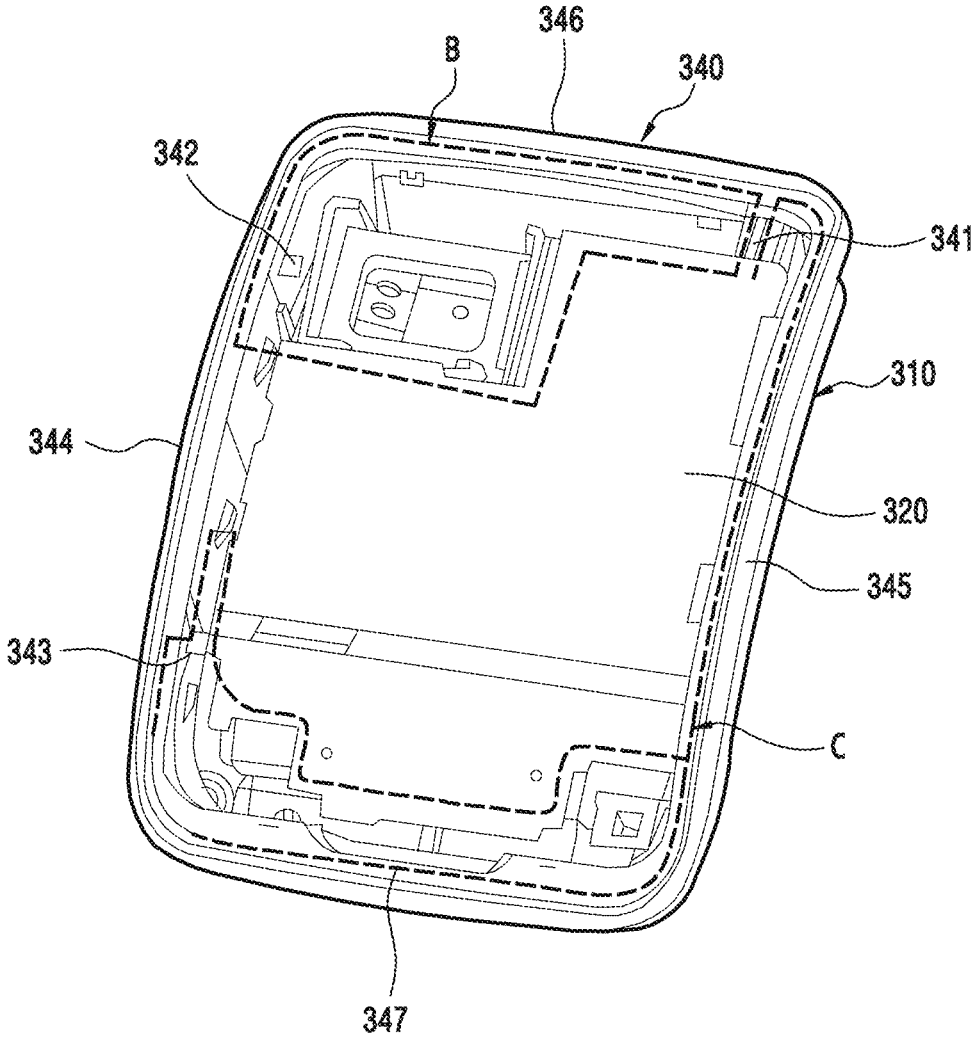
FIGS. 9A, 9B, 9C, and 9D schematically illustrate electrical lengths in various frequency bands that are applied when a metal bezel is used as an antenna radiator according to various embodiments of the present disclosure.
Figure 9B:
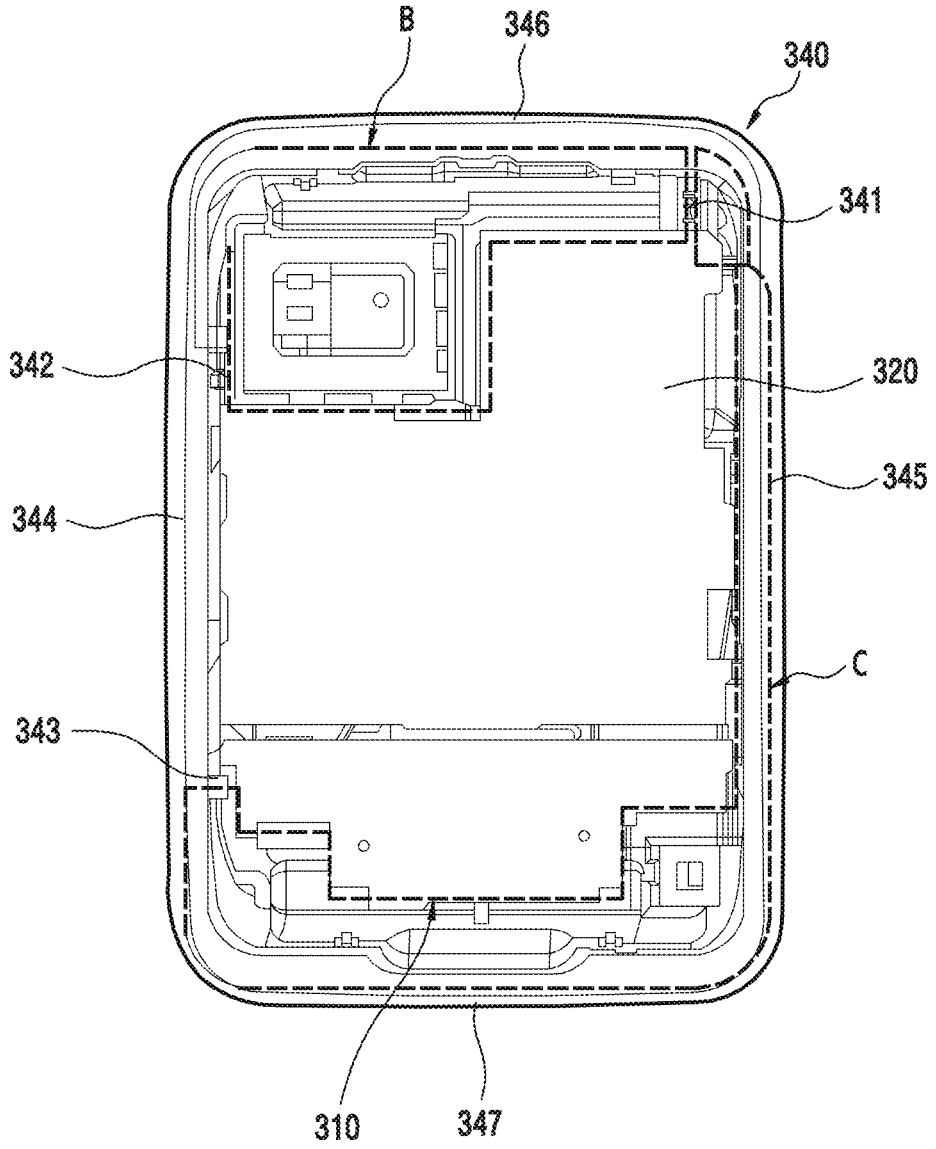

Referring to FIGS. 9A and 9B, a radiation area B in a relatively higher frequency band may be formed by an antenna in the shape of a loop which is formed by the power supply part 341 and the first ground part 342 of the metal bezel 340 and the substrate 320. According to an embodiment of the present disclosure, the dotted closed curve C may correspond to the loop, and the length of the loop may form a lambda length.

According to various embodiments of the present disclosure, in the calculation of the loop and the PIFA length, the loop is subjected to antenna resonance at the length of a closed curve, and the closed curve is a tangent line and is made between a metal and a substrate (printed circuit board (PCB)). Since the closed curve may be short in length due to an influence of the surrounding permittivity, particularly, the electric permittivity of glass (er=4), the closed curve may be affected by the surroundings and thus may be a resonance length.

Figure 9C:
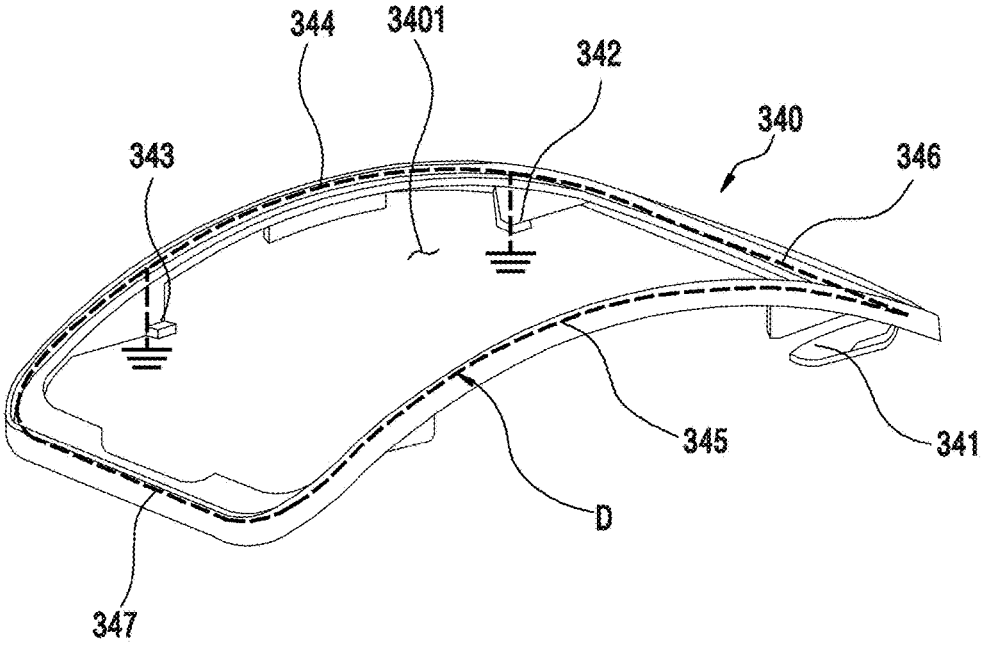

Referring to FIG. 9C, at least one of the power supply part 341 and the first and second ground parts 342 and 343 of the metal bezel 340 may be used as a ground part so that the whole metal bezel may also form the operating area D of the PIFA.

Figure 13A:
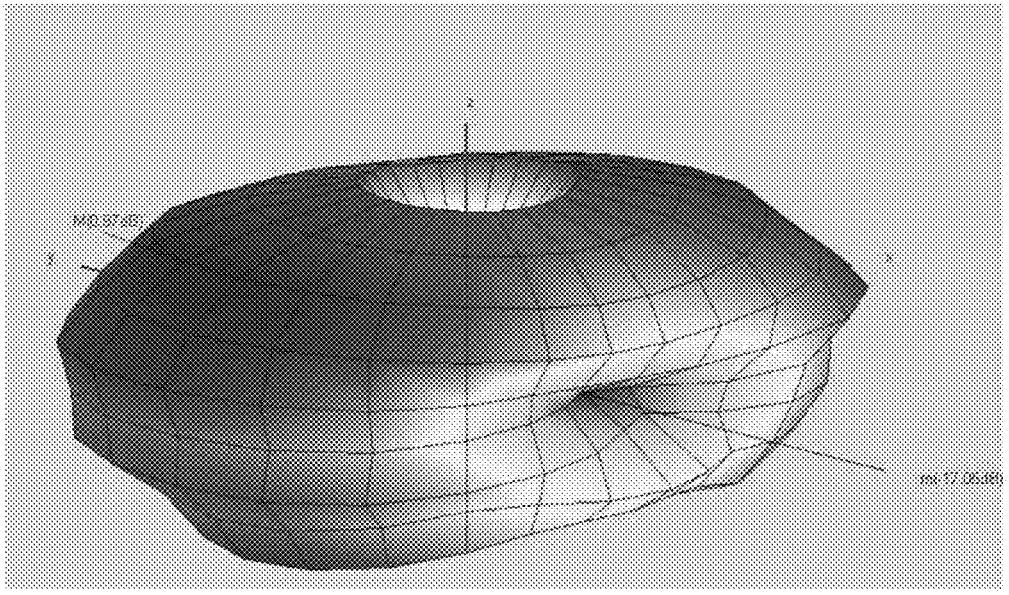
FIGS. 13A, 13B, and 13C illustrate radiation patterns of a metal bezel, which is used as an antenna radiator, in various frequency bands according to various embodiments of the present disclosure.
Figure 13B:
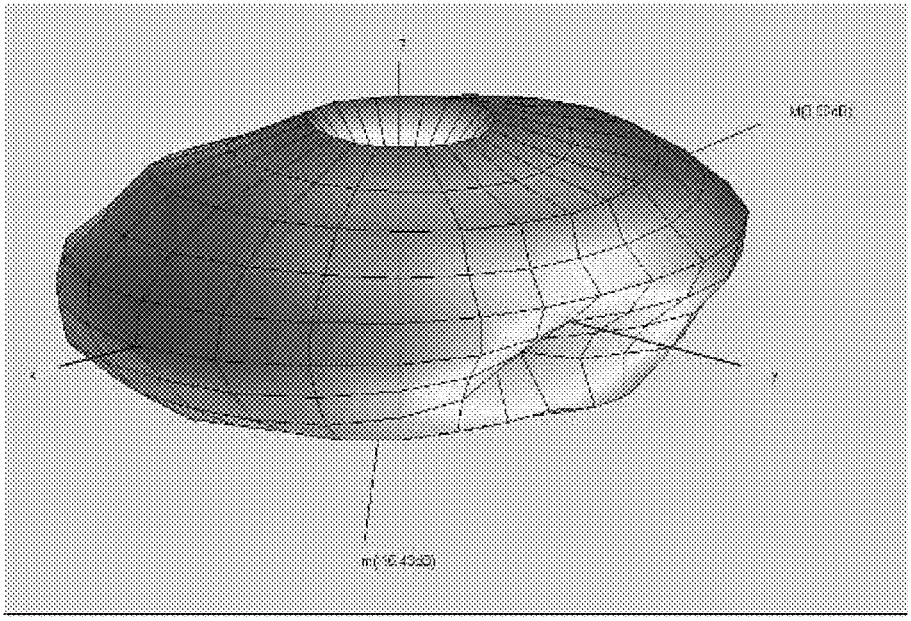
Figure 13C:
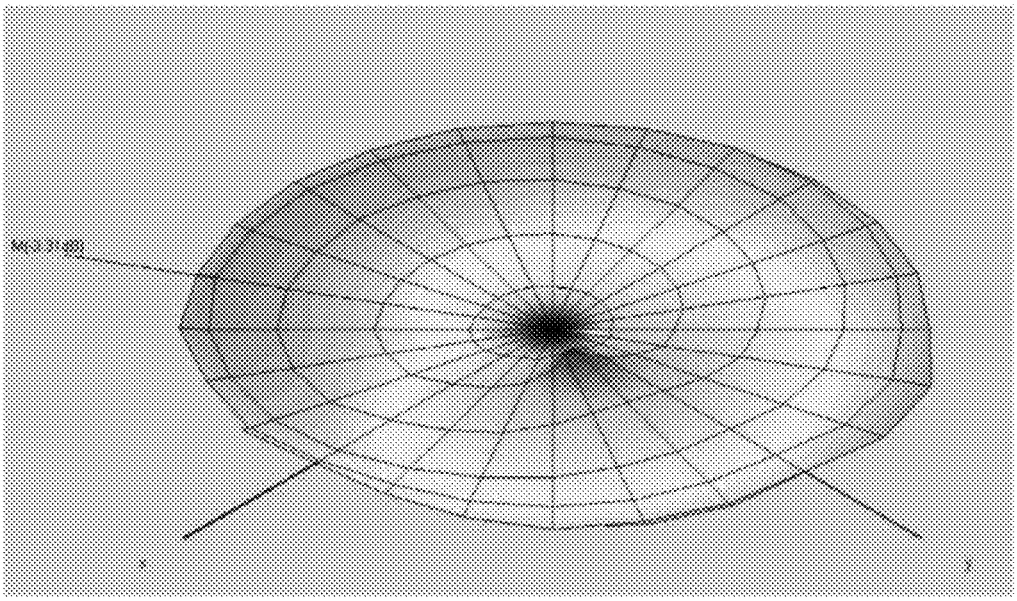

FIGS. 13A, 13B, and 13C illustrate radiation patterns of a metal bezel, which is used as an antenna radiator, in various frequency bands according to various embodiments of the present disclosure.

Referring to FIGS. 13A, 13B, and 13C, FIG. 13A illustrates the radiation pattern of an antenna in the shape of a loop in a high frequency band, and it can be seen that there is Null in the Y-axis direction because the metal bezel operates as an antenna in the shape of a loop. FIG. 13B illustrates the radiation pattern of a PIFA in a high frequency band. FIG. 13C illustrates the radiation pattern of an antenna in the shape of a loop in a low frequency band. It can be seen that there is Null in the Z-axis direction because the metal bezel operates as a loop antenna.

According to various embodiments of the present disclosure, a high frequency band may be expanded by adjusting the frequency bands of an antenna in the shape of a loop and a PIFA in the high frequency band. According to an embodiment of the present disclosure, since operating frequency bands of a high frequency band and a low frequency band may be adjusted by changing the location of each ground part, an undesired mechanical change according to antenna design may be minimized when the metal bezel is used as a decoration member or external appearance of an electronic device.

Figure 10:
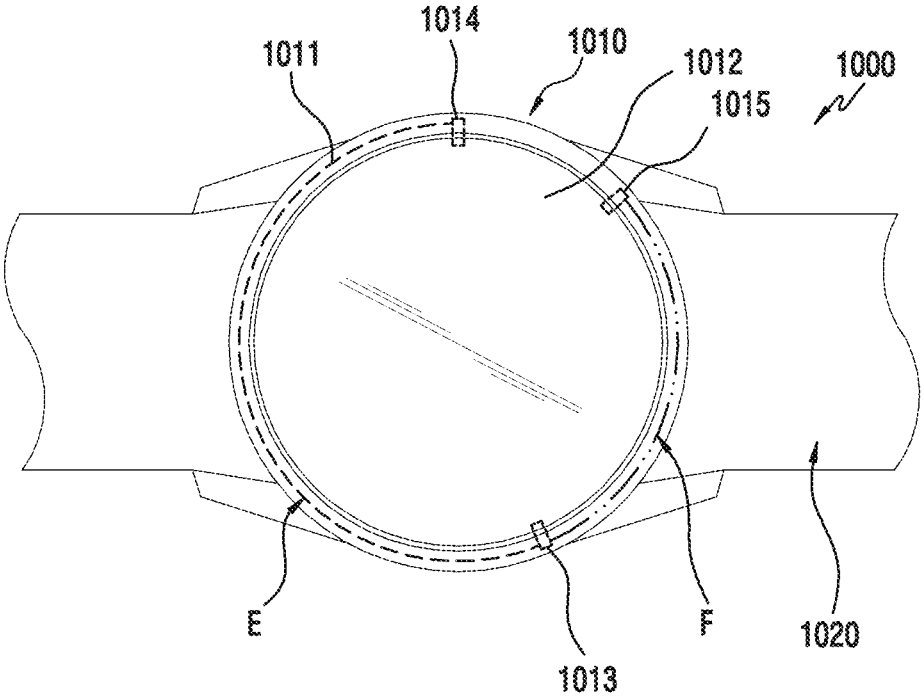
FIG. 10 illustrates an electronic device to which a circular metal bezel is applied according to various embodiments of the present disclosure.

FIG. 10 illustrates an electronic device to which a circular metal bezel is applied according to various embodiments of the present disclosure.

Referring to FIG. 10, a circular metal bezel 1011, which is applied to a circular electronic device 1000 rather than a rectangular electronic device, may also be used as the same loop type of antenna radiator as described above.

According to various embodiments of the present disclosure, the electronic device 1000 may include a main body 1010 that is fixed by a connection part 1020, and the metal bezel 1011 may be installed in such a manner of surrounding a circular display 1012.

Figure 9D:
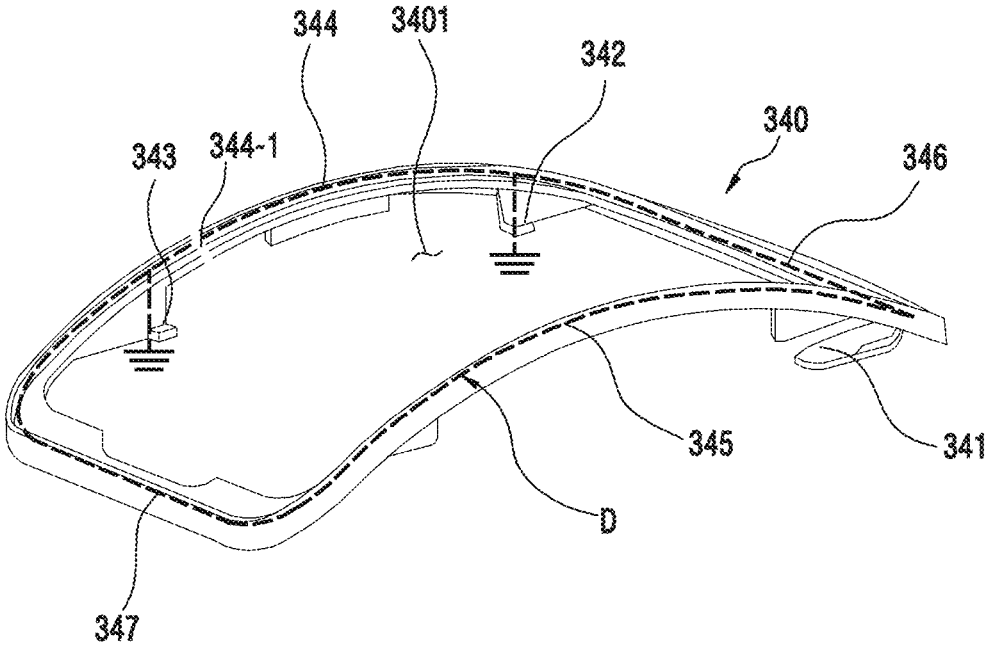

Referring to FIGS. 9D and 10, according to an embodiment of the present disclosure, the metal bezel 1011 may have the shape of a closed loop, or may have the shape of a partially open loop that includes at least one cutaway portion 344-1 as illustrated in FIG. 9D. According to an embodiment of the present disclosure, the metal bezel 1011 may include a power supply part 1013 and first and second ground parts 1014 and 1015 that are spaced a certain distance apart from the power supply part 1013, and the power supply part 1013 and the first and second ground parts 1014 and 1015 may be electrically connected to a substrate in the interior of a main body, which is not illustrated. In this case, the metal bezel 1011 may be used as a multi-band antenna device operating in different frequency bands, for example, by a radiation area E from the power supply part 1013 to the first ground part 1014 in one direction and another radiation area F from the power supply part 1013 to the second ground part 1015 in another direction.

Figure 11:
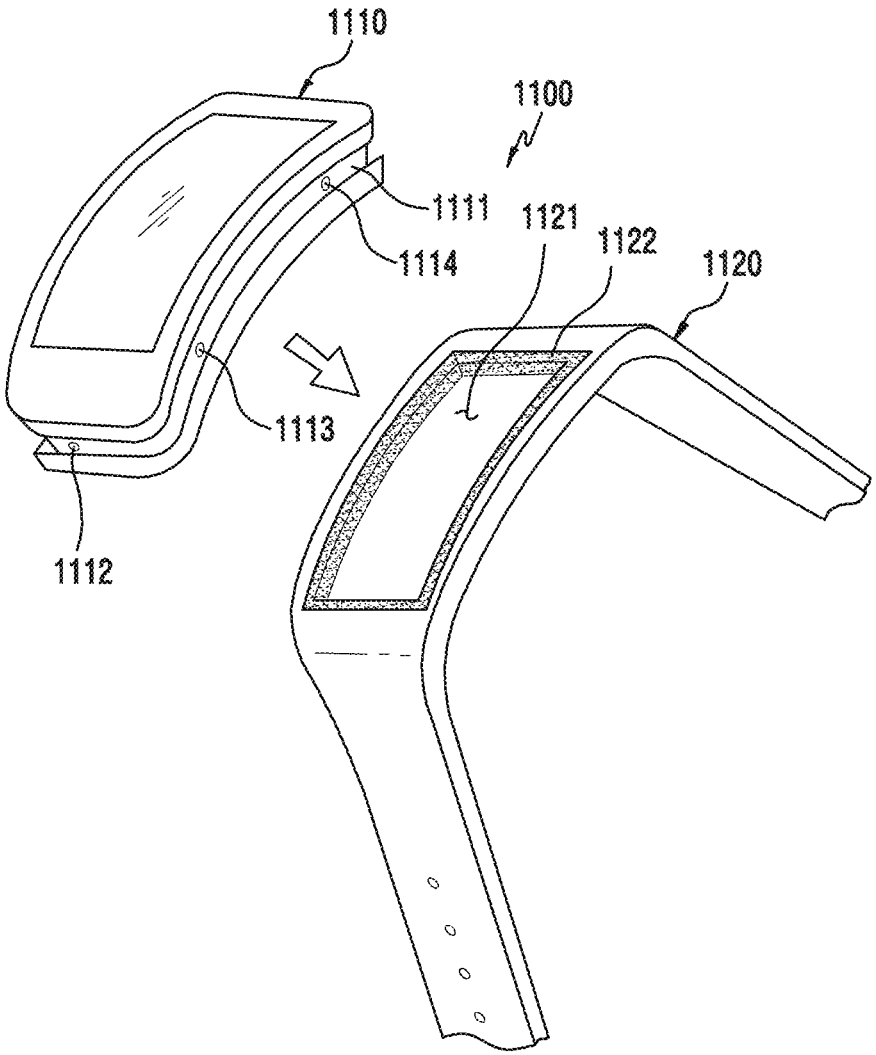
FIG. 11 illustrates a state in which a metal bezel, as an antenna radiator, is applied to a connection part of a wearable electronic device according to various embodiments of the present disclosure.

FIG. 11 illustrates a state in which a metal bezel, as an antenna radiator, is applied to a connection part of a wearable electronic device according to various embodiments of the present disclosure.

Referring to FIG. 11, an electronic device 1100 may include a main body 1110 and a connection part 1120. The connection part 1120 may have a main-body insertion hole 1121 in which the main body 1110 is mounted. According to an embodiment of the present disclosure, a metal bezel 1122 may be disposed along the inner periphery of the main-body insertion hole 1121. According to an embodiment of the present disclosure, the main body 1110 may be formed in a positioning slit 1111 that may be seated on the main-body insertion hole 1121. According to an embodiment of the present disclosure, a power supply part 1112 and first and second ground parts 1113 and 1114, which protrude toward the outside or are exposed to the outside, may be disposed on the positioning slit 1111. According to an embodiment of the present disclosure, the power supply part 1112 and the first and second ground parts 1113 and 1114 are electrically connected to a substrate disposed in the interior of the main body 1110, and portions thereof protruding from the positioning slit may be implemented in the shape of a connector pin. According to an embodiment of the present disclosure, only by an operation of fixing the main body 1110 to the main-body insertion hole 1121 of the connection part 1120, the power supply part 1112 and the first and second ground parts 1113 and 1114, which are disposed in the positioning slit 1111 of the main body 1110, may be electrically connected to a preset area of the metal bezel 1122.

According to the various embodiments of the present disclosure, even though a metal mechanical part (e.g., a metal housing, a metal bezel, and the like) is applied in order to ensure the strength and appealing appearance of an electronic device, the metal mechanical part can be used as an antenna radiator to achieve excellent radiation performance of the antenna device, and a separate mounting space for the antenna device can be excluded so that the metal mechanical part contributes to the slimness of the electronic device.

Figure 14:
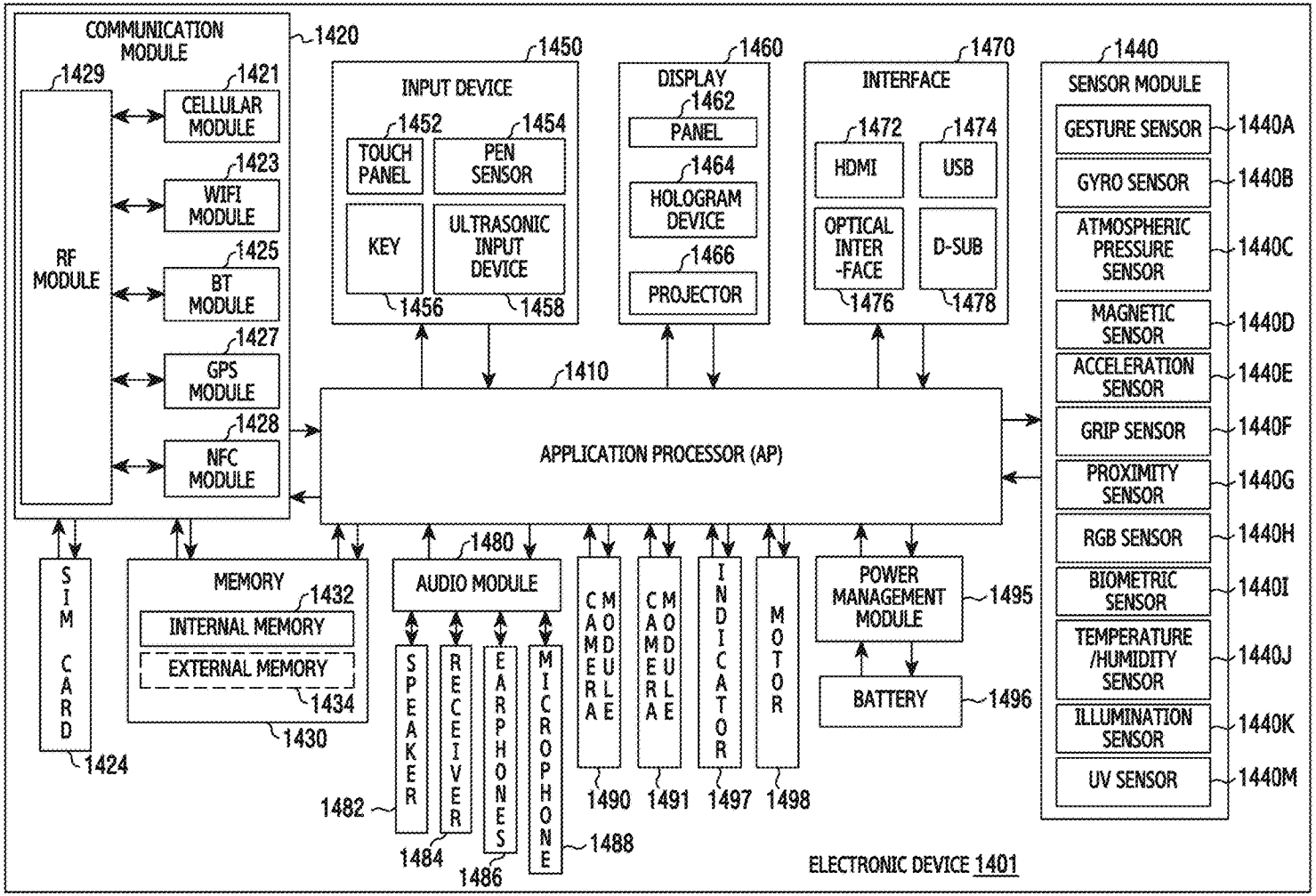
FIG. 14 is a block diagram of a configuration of an electronic device according to various embodiments of the present disclosure.

FIG. 14 is a block diagram of a configuration of an electronic device according to an embodiment of the present disclosure.

Referring to FIG. 14, a configuration of election device 1401 is provided. The electronic device 1401 may entirely or partially constitute the electronic device 101 of FIG. 1, the device 200 of FIGS. 2A, 2B, and 3. Electronic device 1401 includes at least one application processor (AP) 1410, a communication module 1420, a subscriber identification module (SIM) card 1424, a memory 1430, a sensor module 1440, an input device 1450, a display 1460, an interface 1470, an audio module 1480, a camera module 1490, a camera module 1491, a power management module 1495, a battery 1496, an indicator 1497, and a motor 1498.

The AP 1410 controls a plurality of hardware or software elements connected to the AP 1410 by driving an operating system or an application program. The AP 1410 processes a variety of data, including multimedia data, and performs arithmetic operations. The AP 1410 may be implemented, for example, with a system on chip (SoC). The AP 1410 may further include a Graphical processing unit (GPU).

The communication module 1420 (e.g., the communication interface 160) performs data transmission/reception in communication between other electronic devices (e.g., the external electronic device 104 or the server 106) connected with the electronic device 1401 through a network. The communication module 1420 includes a cellular module 1421, a Wi-Fi module 1423, a BT module 1425, a GPS module 1427, a NFC module 1428, and a radio frequency (RF) module 1429.

The cellular module 1421 provides a voice call, a video call, a text service, an internet service, and the like, through a communication network (e.g., LTE, LTE-A, CDMA, WCDMA, UMTS, WiBro, and GSM, and the like). In addition, the cellular module 1421 identifies and authenticates the electronic device 1401 within the communication network by using a SIM card 1424. The cellular module 1421 may perform at least some of functions that can be provided by the AP 1410. For example, the cellular module 1421 may perform at least some of multimedia control functions.

The cellular module 1421 includes a communication processor (CP). Further, the cellular module 1421 may be implemented, for example, with an SoC. Although elements, such as the cellular module 1421 (e.g., the CP), the memory 1430, and the power management module 1495 are illustrated as separate elements with respect to the AP 1410 in FIG. 14, the AP 1410 may also be implemented such that at least one part (e.g., the cellular module 1421) of the aforementioned elements is included in the AP 1410.

The AP 1410 or the cellular module 1421 (e.g., the CP) loads an instruction or data, which is received from each non-volatile memory connected thereto or at least one of different elements, to a volatile memory and processes the instruction or data. In addition, the AP 1410 or the cellular module 1421 stores data, which is received from at least one of different elements or generated by at least one of different elements, into the non-volatile memory.

Each of the Wi-Fi module 1423, the BT module 1425, the GPS module 1427, and the NFC module 1428 includes a processor for processing data transmitted/received through a corresponding module. Although the cellular module 1421, the Wi-Fi module 1423, the BT module 1425, the GPS module 1427, and the NFC module 1428 are illustrated in FIG. 14 as separate blocks, according to one embodiment of the present disclosure, at least some (e.g., two or more) of the cellular module 1421, the Wi-Fi module 1423, the BT module 1425, the GPS module 1427, and the NFC module 1428 may be included in one integrated chip (IC) or IC package. For example, at least some of processors corresponding to the cellular module 1421, the Wi-Fi module 1423, the BT module 1425, the GPS module 1427, and the NFC module 1428 (e.g., a communication processor corresponding to the cellular module 1421 and a Wi-Fi processor corresponding to the Wi-Fi module 1423) may be implemented with an SoC.

The RF module 1429 transmits/receives data, for example an RF signal. The RF module 1429 may include, for example, a transceiver, a power amp module (PAM), a frequency filter, a low noise amplifier (LNA), and the like. In addition, the RF module 1429 may further include a component for transmitting/receiving a radio wave on a free space in wireless communication, for example, a conductor, a conducting wire, and the like. Although it is illustrated in FIG. 14 that the cellular module 1421, the Wi-Fi module 1423, the BT module 1425, the GPS module 1427, and the NFC module 1428 share one RF module 1429, according to one embodiment of the present disclosure, at least one of the cellular module 1421, the Wi-Fi module 1423, the BT module 1425, the GPS module 1427, the NFC module 1428 may transmit/receive an RF signal via a separate RF module.

The SIM card 1424 is a card which is inserted into a slot formed at a specific location of the electronic device 1401. The SIM card 1424 includes unique identification information (e.g., an integrated circuit card identifier (ICCID)) or subscriber information (e.g., an international mobile subscriber identity (IMSI)).

The memory 1430 (e.g., the memory 130) includes an internal memory 1432 or an external memory 1434.

The internal memory 1432 may include, for example, at least one of a volatile memory (e.g., a dynamic random access memory (DRAM), a static RAM (SRAM), a synchronous dynamic RAM (SDRAM), and the like) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, and the like). The internal memory 1432 may be a solid state drive (SSD).

The external memory 1434 may include a flash drive, and may further include, for example, compact flash (CF), secure digital (SD), micro-SD, mini-SD, extreme digital (xD), memory stick, and the like. The external memory 1434 may be operatively coupled to the electronic device 1401 via various interfaces.

The electronic device 1401 may further include a storage unit (or a storage medium), such as a hard drive.

The sensor module 1440 measures a physical quantity or detects an operation state of the electronic device 1401, and converts the measured or detected information into an electric signal. The sensor module 1440 includes, for example, at least one of a gesture sensor 1440A, a gyro sensor 1440B, a barometric pressure sensor 1440C, a magnetic sensor 1440D, an acceleration sensor 1440E, a grip sensor 1440F, a proximity sensor 1440G, a color sensor 1440H (e.g., a red, green, blue (RGB) sensor), a bio sensor 1440I, a temperature/humidity sensor 1440J, an illumination sensor 1440K, and an ultraviolet (UV) sensor 1440M. Additionally or alternatively, the sensor module 1440 may include, for example, an E-node sensor, an electromyography (EMG) sensor, an electroencephalogram (EEG) sensor, an electrocardiogram (ECG) sensor, a fingerprint sensor, and the like. The sensor module 1440 may further include a control circuit for controlling at least one or more sensors included therein.

The input device 1450 includes a touch panel 1452, a (digital) pen sensor 1454, a key 1456, or an ultrasonic input unit 1458.

The touch panel 1452 recognizes a touch input, for example, by using at least one of an electrostatic type, a pressure-sensitive type, and an ultrasonic type. The touch panel 1452 may further include a control circuit. In case of the electrostatic type of touch panel 1452, not only is physical contact recognition possible, but proximity recognition is also possible. The touch penal 1452 may further include a tactile layer. In this case, the touch panel 1452 provides the user with a tactile reaction.

The (digital) pen sensor 1454 may be implemented, for example, by using the same or similar method of receiving a touch input of the user or by using an additional sheet for recognition.

The key 1456 may be, for example, a physical button, an optical key, a keypad, or a touch key.

The ultrasonic input unit 1458 is a device by which the electronic device 1401 detects a sound wave through a microphone 1488 by using a pen which generates an ultrasonic signal, and is capable of radio recognition.

The electronic device 1401 may use the communication module 1420 to receive a user input from an external device (e.g., a computer or a server) connected thereto.

The display 1460 (e.g., the display 150) includes a panel 1462, a hologram 1464, or a projector 1466.

The panel 1462 may be, for example, a liquid-crystal display (LCD), an active-matrix organic light-emitting diode (AM-OLED), and the like. The panel 1462 may be implemented, for example, in a flexible, transparent, or wearable manner. The panel 1462 may be constructed as one module with the touch panel 1452.

The hologram 1464 uses an interference of light and displays a stereoscopic image in the air.

The projector 1466 displays an image by projecting a light beam onto a screen. The screen may be located inside or outside the electronic device 1401.

The display 1460 may further include a control circuit for controlling the panel 1462, the hologram 1464, or the projector 1466.

The interface 1470 includes, for example, an HDMI 1472, a USB 1474, an optical communication interface 1476, or a D-subminiature (D-sub) 1478. The interface 1470 may be included, for example, in the communication interface 160 of FIG. 1. Additionally or alternatively, the interface 1470 may include, for example, mobile high-definition link (MHL) (not shown), SD/multi-media card (MMC) or infrared data association (IrDA).

The audio module 1480 bilaterally converts a sound and electric signal. At least some elements of the audio module 1480 may be included in the input/output interface 140 of FIG. 1. The audio module 1480 converts sound information which is input or output through a speaker 1482, a receiver 1484, an earphone 1486, the microphone 1488, and the like.

Each of the camera modules 1490 and 1491 is a device for image and video capturing, and may include one or more image sensors (e.g., a front sensor or a rear sensor), a lens, an image signal processor (ISP) (not shown), or a flash (not shown, e.g., an LED or a xenon lamp).

The power management module 1495 manages power of the electronic device 1401. The power management module 1495 may include a power management integrated circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 1496 and a voltage, current, and temperature during charging. The battery 1496 stores or generates electricity and supplies power to the electronic device 1401 by using the stored or generated electricity. The battery 1496 may include a rechargeable battery or a solar battery.

The indicator 1497 indicates a specific state, for example, a booting state, a message state, a charging state, and the like, of the electronic device 1401 or a part thereof (e.g., the AP 1410).

The motor 1498 converts an electric signal into a mechanical vibration.

The electronic device 1401 includes a processing unit (e.g., a GPU) for supporting mobile TV. The processing unit for supporting mobile TV processes media data according to a protocol of, for example, digital multimedia broadcasting (DMB), digital video broadcasting (DVB), media flow, and the like.

Each of the aforementioned elements of the electronic device according to various embodiments of the present disclosure may consist of one or more components, and names thereof may vary depending on a type of electronic device. The electronic device according to various embodiments of the present disclosure may include at least one of the aforementioned elements. Some of the elements may be omitted, or additional other elements may be further included. In addition, some of the elements of the electronic device may be combined and constructed as one entity, so as to equally perform functions of corresponding elements before combination.

The term "module" used herein may imply a unit including one of hardware, software, and firmware, or a combination of them. The term "module" may be interchangeably used with terms, such as unit, logic, logical block, component, circuit, and the like. The "module" may be a minimum unit of an integrally constituted component or may be a part thereof. The "module" may be a minimum unit for performing one or more functions or may be a part thereof. The "module" may be mechanically or electrically implemented. For example, the "module" of the present disclosure includes at least one of an application-specific IC (ASIC) chip, a field-programmable gate arrays (FPGAs), and a programmable-logic device, which are known or will be developed and which perform certain operations.

According to various embodiments of the present disclosure, at least some parts of a device (e.g., modules or functions thereof) or method (e.g., operations) may be implemented with an instruction stored in a computer-readable storage media for example. The instruction may be executed by one or more processors (e.g., the processor 1410), to perform a function corresponding to the instruction. The computer-readable storage media may be, for example, the memory 1430. At least some parts of the programming module may be implemented (e.g., executed), for example, by the processor 1410. At least some parts of the programming module may include modules, programs, routines, sets of instructions, processes, and the like, for performing one or more functions.

Certain aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present disclosure can be easily construed by programmers skilled in the art to which the present disclosure pertains.

At this point it should be noted that the various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure can be easily construed by programmers skilled in the art to which the present disclosure pertains.

The module or programming module according to various embodiments of the present disclosure may further include at least one or more elements among the aforementioned elements, may omit some of them, or may further include additional elements. Operations performed by a module, programming module, or other elements may be executed in a sequential, parallel, repetitive, or heuristic manner. In addition, some of the operations may be executed in a different order or may be omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a metal bezel comprising an antenna radiator in a shape of a loop that is disposed in at least one area of the electronic device, the antenna radiator comprising two grounded locations of which the electrical lengths from a preset power-supplied location are different from each other;

a substrate (printed circuit board (PCB)) for supplying power to the preset power-supplied location of the antenna radiator; and an inner housing including a first portion having a first conductive pattern, a second portion having a second conductive pattern different from the first conductive pattern and a third portion having a third conductive pattern different from the first conductive pattern and the second conductive pattern and configured to electrically connect the metal bezel and the substrate through each of the first portion, second portion and the third portion, wherein at least one location of the antenna radiator that differs from the power-supplied location is grounded through the substrate, and wherein an operation frequency band of the antenna radiator is adjusted based on at least one of the first conductive pattern, second conductive pattern and the third conductive pattern.

2. The electronic device of claim 1, wherein the metal bezel is disposed such that at least a part thereof is exposed to the outside of the electronic device.

3. The electronic device of claim 1, further comprising:

a display, wherein the metal bezel is disposed in such a manner as to surround at least part of the periphery of the display.

4. The electronic device of claim 1, wherein an area other than the area where the power-supplied location and the grounded location of the metal bezel are connected to each other comprises at least one cutaway portion.

5. The electronic device of claim 1, wherein an operating frequency band of the antenna radiator is adjusted by adjusting the electrical length between the power-supplied location and the grounded location of the metal bezel according to the grounded location.

6. The electronic device of claim 1, wherein the metal bezel is operated as a loop type antenna radiator, which includes operating frequency bands of a high frequency band and a low frequency band based on the two grounded locations.

7. The electronic device of claim 1, wherein the frequency band of the metal bezel is adjusted by adjusting the electrical length of the conductive pattern disposed on the inner housing.

8. The electronic device of claim 1, wherein the first conductive pattern disposed on the inner housing is physically and electrically connected in the process of assembling the inner housing, the metal member, and the substrate.

9. The electronic device of claim 8, wherein the first conductive pattern of the inner housing and the metal bezel and the first conductive pattern and the substrate are electrically connected by an electrical connection member.

10. The electronic device of claim 9, wherein the electrical connection member comprises at least one of a conductive Poron tape, a conductive gasket, and a conductive tape.

11. The electronic device of claim 1, wherein the first conductive pattern disposed on the inner housing is formed on the inner housing through a laser direct structuring (LDS) method or an in-mold antenna (IMA) method, through a method of attaching at least one of a flexible printed circuit (FPC), on which a thin metal plate or pattern is formed, and a metal tape to the inner housing, through a method of applying a conductive spray to the inner housing, or through insert molding or double injection molding in such a manner that the conductive pattern is or is not exposed through the inner or outer surface of the inner housing.

12. The electronic device of claim 1, wherein the second conductive pattern is disposed on the side surface of the inner housing.

13. The electronic device of claim 1, wherein the electronic device comprises a wearable electronic device that comprises a main body and a connection part by which the main body is worn on a user's wrist.

14. The electronic device of claim 13, wherein the metal bezel is disposed to surround at least part of the periphery of a window or a display that is disposed on the main body.

15. The electronic device of claim 14, wherein the metal bezel is disposed on the connection part, and wherein the metal bezel is electrically connected to the substrate for supplying power only by an operation of mounting the main body on the connection part.

* * * * *